US010562651B1

(12) United States Patent
Laible

(10) Patent No.: US 10,562,651 B1
(45) Date of Patent: Feb. 18, 2020

(54) APPARATUS FOR INSERTING AN INSERT INTO THE THROAT OF A LIQUID CONTAINER

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 16/354,812

(22) Filed: Mar. 15, 2019

(51) Int. Cl.
*B65B 7/28* (2006.01)
*B65D 83/32* (2006.01)
*B67B 3/26* (2006.01)

(52) U.S. Cl.
CPC ..... *B65B 7/28* (2013.01); *B65B 7/2807* (2013.01); *B65D 83/32* (2013.01); *B67B 3/26* (2013.01); *B67B 2201/12* (2013.01)

(58) Field of Classification Search
CPC ..... B65B 7/28; B65B 7/2807; B67B 1/005; B67B 1/04; B67B 3/22; B67B 3/26; B67B 6/00; B67B 2201/12; B05B 15/30; B65D 83/32; Y10T 29/53335
USPC ..... 53/75, 128.1, 133.1, 133.2, 306, 319, 53/324, 328; 29/776; 493/87
See application file for complete search history.

(56) References Cited

U.S. PATENT DOCUMENTS 2,781,576 A * 2/1957 Jennings ..... B67B 1/04 29/235
3,212,174 A * 10/1965 Wonneman ..... B65B 7/28 29/709
3,212,175 A * 10/1965 Wonneman ..... B65B 7/28 29/776
3,360,844 A * 1/1968 Wonneman ..... B65B 7/28 29/776
3,616,513 A * 11/1971 Dimond ..... B21D 51/42 29/776
3,708,854 A * 1/1973 Nalbach ..... B65B 7/28 29/809
5,493,849 A * 2/1996 Itoh ..... B67B 1/04 53/489
5,988,456 A 11/1999 Laible
6,142,345 A 11/2000 Laible
6,968,983 B2 11/2005 Laible
7,322,170 B2 * 1/2008 Tonnalesky et al. ..... B65B 7/2835 141/129
7,735,297 B2 * 6/2010 Monti ..... B67B 1/04 53/286
7,845,148 B2 * 12/2010 Ramnarain et al. .. B65B 7/2835 53/317

(Continued)

FOREIGN PATENT DOCUMENTS

DE 3118462 A1 * 11/1982 ..... B67B 1/04

*Primary Examiner* — Stephen F. Gerrity
(74) *Attorney, Agent, or Firm* — Dennis L. Thomte; Thomte Patent Law Office LLC

(57) ABSTRACT

An apparatus is provided for inserting container inserts into the throats of liquid containers. The apparatus includes an elongated and inclined container insert support tray having an outer end and an inner end with the insert support tray being mounted on a support frame. The insert support tray is vibrated to cause the container inserts therein to move towards the inner end thereof. An insert positioner is mounted at the inner end of the container insert tray. The apparatus also includes a vertically disposed inserter which is mounted on a sub-frame which is horizontally movably mounted on the support frame. The inserter is vertically movable to insert a container insert positioned therebelow into the throat of the container.

2 Claims, 24 Drawing Sheets

(56) References Cited

U.S. PATENT DOCUMENTS

| | | | | |
|---|---|---|---|---|
| 8,083,107 | B2 | 12/2011 | Laible | |
| 8,516,782 | B2 * | 8/2013 | Ramnarain et al. .. | B65B 7/2835 493/87 |
| 9,242,847 | B1 | 1/2016 | Laible | |
| 9,623,990 | B2 * | 4/2017 | Cirio ..... | B65B 7/2842 |
| 2002/0196434 | A1 * | 12/2002 | Takakusaki et al. ..... | B67B 3/26 356/240.1 |
| 2004/0139695 | A1 * | 7/2004 | Monti ..... | B65B 7/2807 53/264 |

* cited by examiner

APPARATUS FOR INSERTING AN INSERT INTO THE THROAT OF A LIQUID CONTAINER

BACKGROUND OF THE INVENTION

Field of the Invention

This invention relates to a machine or apparatus for inserting a container insert into the throat of a liquid container. More particularly, this invention relates to a machine or apparatus for inserting a container insert into the throat of a liquid container having liquid chemical therein which eliminates the possibility of a person coming into contact with the liquid chemical if the insert were to be manually inserted into the throat of the container. Further, the invention relates to an apparatus for inserting container inserts into liquid chemical containers which reduces the labor costs of the prior art method involved in inserting the container inserts into the containers.

Description of the Related Art

Applicant has patented several closed loop dispensing systems. See for example, U.S. Pat. Nos. 5,988,456; 6,142,345; 6,968,983, 8,083,107 and 9,242,847. In those patents, a throat plug, a throat plug assembly or container insert is inserted into the throat of a liquid chemical container, such as a bottle.

Applicant has also filed patent applications related to container inserts for use in closed loop dispensing systems. See U.S. Patent Application Nos. Ser. No. 16/266,744 filed Feb. 4, 2019 and Ser. No. 16/267,867 filed Feb. 5, 2019. In all of the above-identified patents and patent applications, the container insert or throat plug is manually inserted downwardly into the throat of the container. The manual insertion of the container insert into the throat of the container subjects the person to possible exposure to the liquid chemical in the container should an accident occur. Further, in the prior art method of inserting the container insert into the throat of the container, it was necessary for one person to manually insert the container insert into the container with that person or another person using a mallet or hammer to pound the insert into the throat of the container.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An apparatus is provided for inserting a container insert into the throat of a liquid chemical container. The apparatus includes a support frame having an elongated container insert tray, having inner and outer ends, which is mounted on the support frame. The tray is configured to have a plurality of container inserts positioned therein in a row. An insert positioner is positioned at the inner end of the container insert tray.

A sub-frame is horizontally movably secured to the support frame and is movable between inner and outer positions with respect thereto. An insert positioner is positioned at the inner end of the container insert tray. A vertically movable inserter, a dip tube guide and a container stabilizer are mounted on the sub-frame and are movable therewith. The sub-frame, when in its inner position, positions the lower end of the inserter above the innermost container insert in the insert positioner and positions the dip tube guide and the container stabilizer at one side of the inserter. The inserter may be lowered so that the head of the inserter moves into frictional engagement with the container insert. The inserter may pick up the cylinder insert and move it into position over the throat of the liquid container. The inserter may then be lowered to drive the container insert into the throat of the container. The dip tube guide guides the dip tube of the container insert into the throat of the container. The container stabilizer stabilizes the container as the container insert is being inserted into the throat of the container.

It is therefore a principal object of the invention to provide a unique apparatus for inserting a container insert into the throat of a liquid chemical container.

It is therefore a principal object of the invention to provide a unique apparatus for inserting a container insert into the throat of a liquid chemical container which reduces the possibility of an installer from coming into contact with the chemical in the container.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
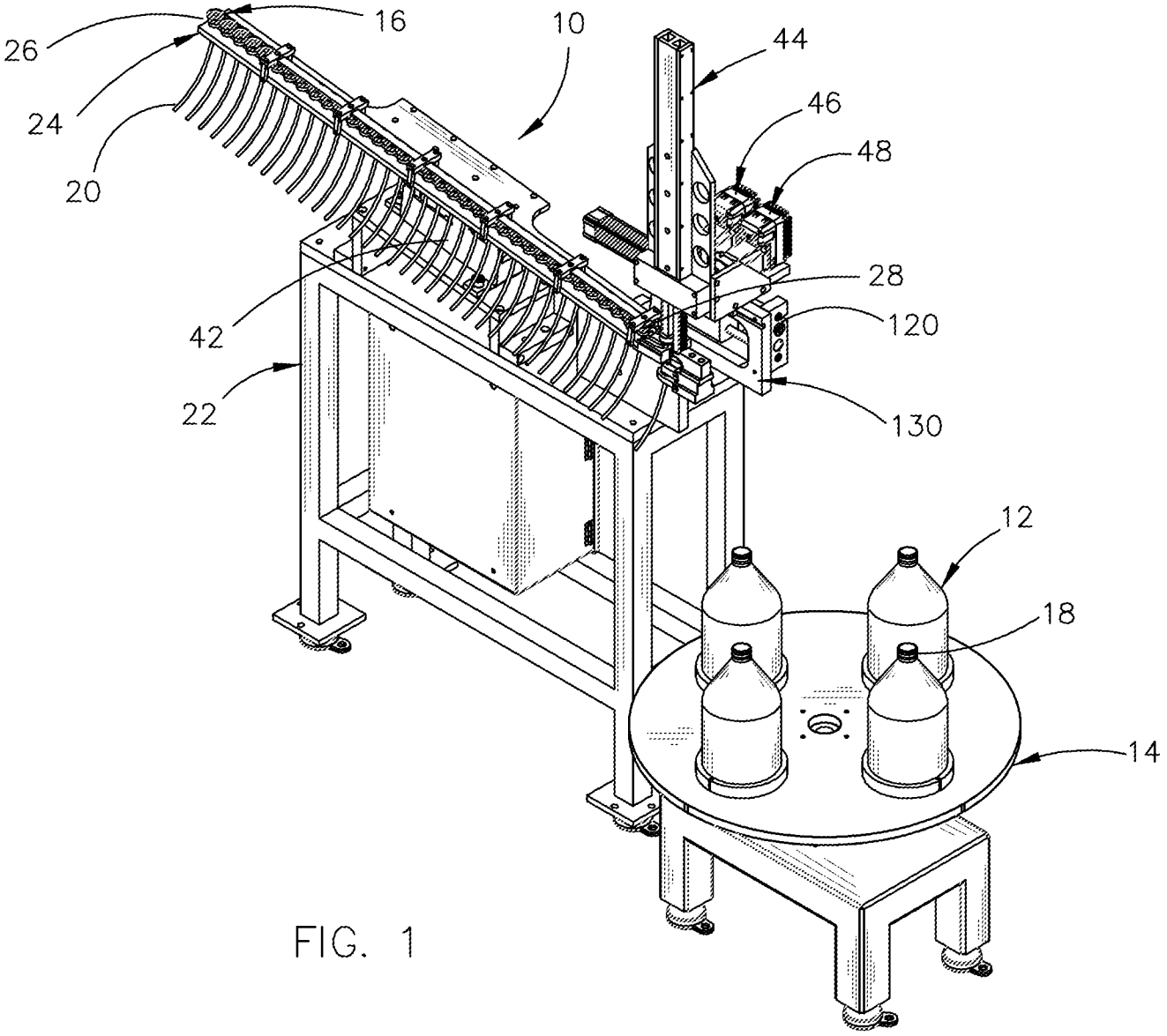
FIG. 1 is a perspective view of the machine of this invention about to insert a container insert into a liquid chemical container.
Figure 1A:
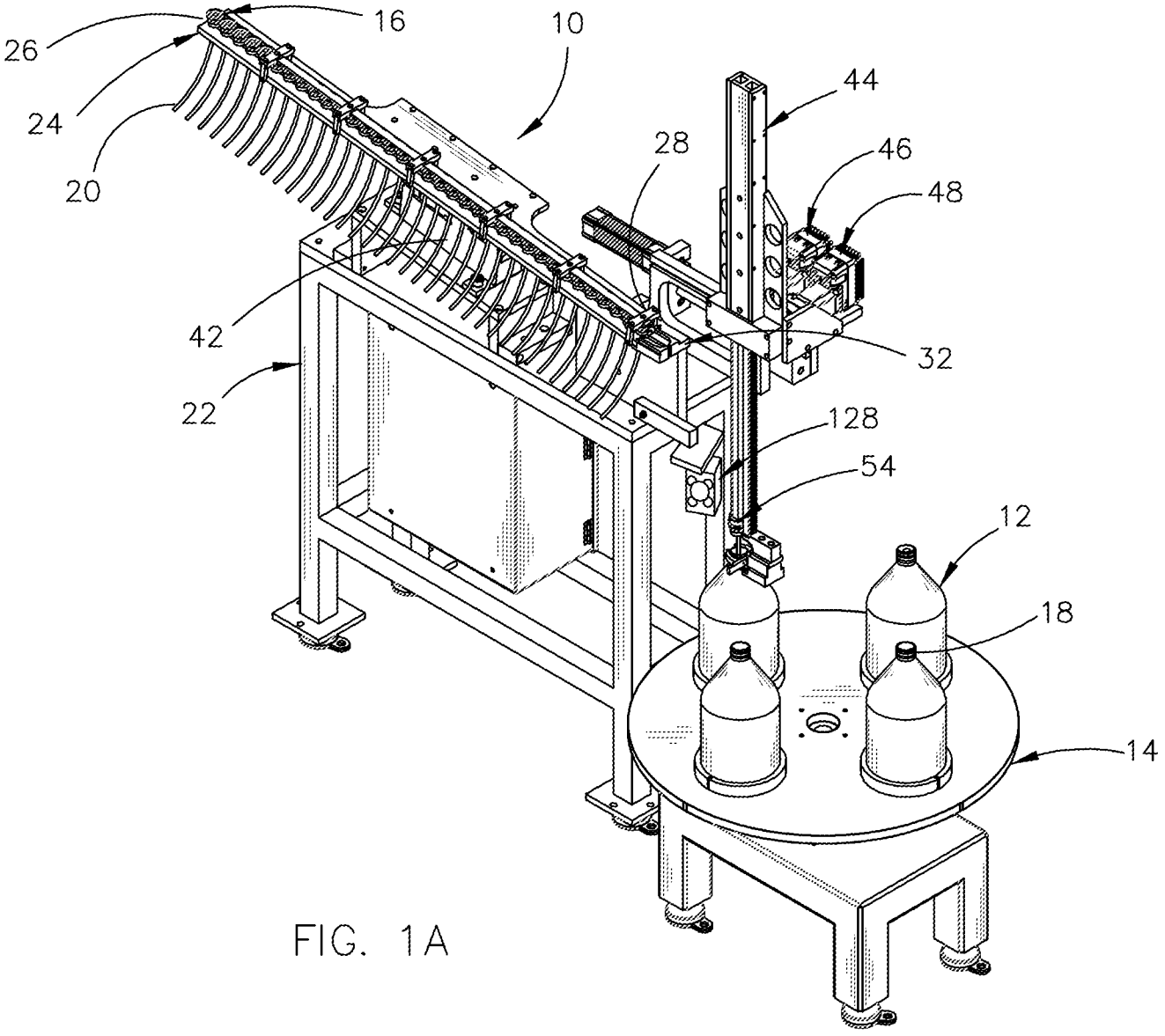
FIG. 1A is a perspective view of the machine of this invention installing a container insert into a liquid chemical container.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The machine or apparatus of this invention is designated generally by the reference numeral 10. The numeral 12 refers to a plurality of liquid containers mounted on some form of conventional structure 14 for providing a succession of liquid filled chemical containers 12 to the machine 10 so that container inserts 16 may be inserted into the throats 18 of the containers 12. The container insert 16 is of the type as disclosed in U.S. Pat. Nos. 5,988,456; 6,142,345; 6,968,983, 8,083,107 and 9,242,847 and, the disclosures of which are incorporated hereto by reference thereto to complete this disclosure if necessary. Each of the container inserts 16 includes a dip tube 20 extending downwardly from the insert 16. The apparatus 10 may be supported upon a frame or stand 22.

Machine 10 includes an elongated and inclined insert support tray 24 having an outer end 26 and an inner end 28. The tray 24 has an elongated slot 30 formed therein at the bottom thereof which is configured to receive the dip tubes 20 of the inserts 16 therein. A horizontally disposed insert positioner 32 is positioned at the inner end 26 of tray 24. Insert positioner 32 includes a top wall 33 which has a U-shaped slot or opening 34 formed therein with the open end of slot 34 being positioned at the inner end of insert support tray 24. The inner end of slot 34 provides a stop for the inserts 16 coming into insert positioner 32. The bottom wall of insert positioner 32 has a slot 36 formed therein which communicates with the inner end of slot 30 of insert support tray 24 and which is configured to receive the dip tubes 20 therein. The end wall 38 of insert positioner 32 has a slot 40 formed therein which communicates with slot 36. The insert support tray 24 is vibrated by a conventional vibrator 42. The vibration of insert support tray 24 causes the container inserts in the insert support tray to move downwardly in the insert support tray 24 towards end 28 of insert support tray 24.

The numeral 44 refers to a vertically disposed servomotor support having conventional servomotors 46 and 48 mounted thereon. The numeral 50 refers to an elongated inserter which is vertically movably mounted on support 44. Inserter 50 has teeth 52 at one side thereof which nest with the drive gear or pinion in servomotor 46. The activation of servomotor 46 in one direction causes inserter 50 to move upwardly. The activation of servomotor 46 in an opposite direction causes inserter 50 to move downwardly.

Figure 10B:
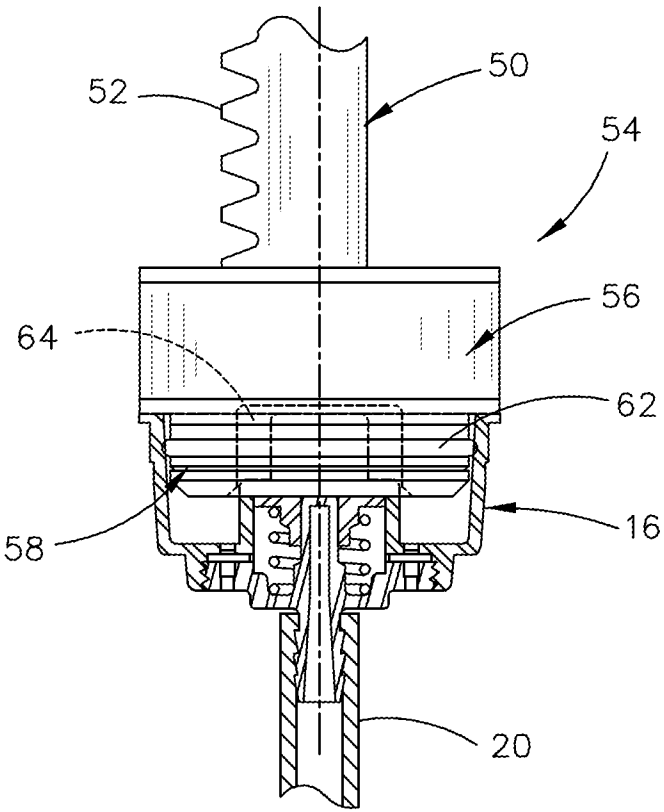
FIG. 10B is a view similar to FIG. 10A except that the head portion of the inserter has been received in the insert.
Figure 10A:
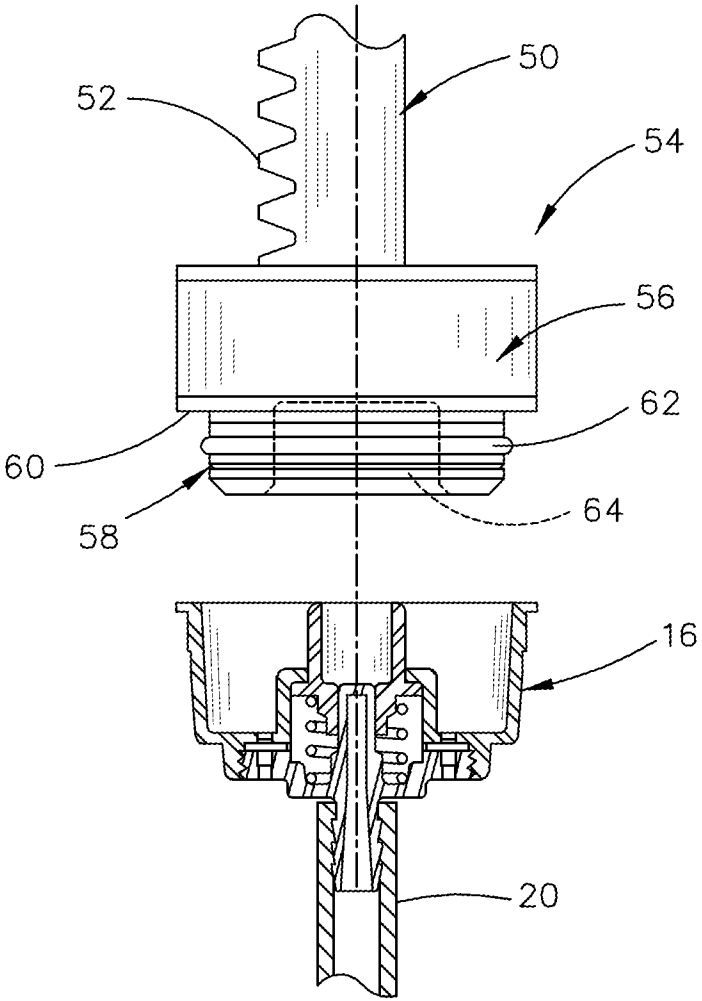
FIG. 10A is a partial side elevational and sectional view of the lower end of the inserter being positioned above an insert.

An enlarged cylindrical head 54 is mounted on the lower end of inserter 50. Head 54 includes an upper cylindrical portion 56 and a lower cylindrical portion 58. As seen, upper cylindrical portion 56 has a greater diameter than lower cylindrical portion 58 to create a shoulder 60 therebetween. The exterior surface of lower cylindrical portion 58 has an O-ring 62 mounted thereon. As seen in FIG. 10A, head 54 has a cavity 64 extending upwardly into lower cylindrical portion 58.

The numeral 66 refers to an elongated rack which is vertically movable on the servomotor support 44. Rack 66 includes teeth 68 at one side thereof which mesh with the drive gear or pinion of servomotor 48. Rack 66 is movable between upper and lower positions with respect to servomotor support 44.

Figure 11A:
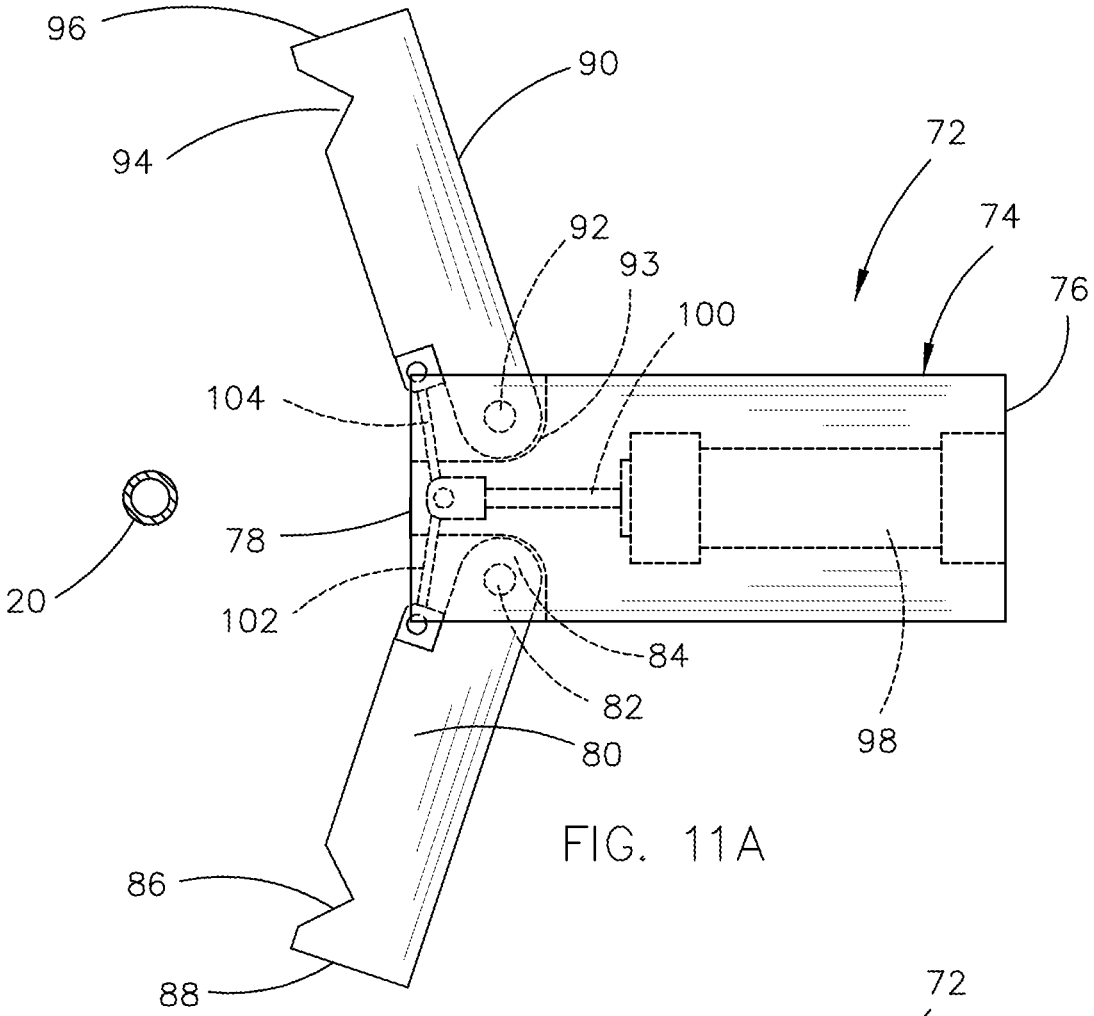
FIG. 11A is an upper elevational view of the dip tube guide is in an open position.
Figure 11B:
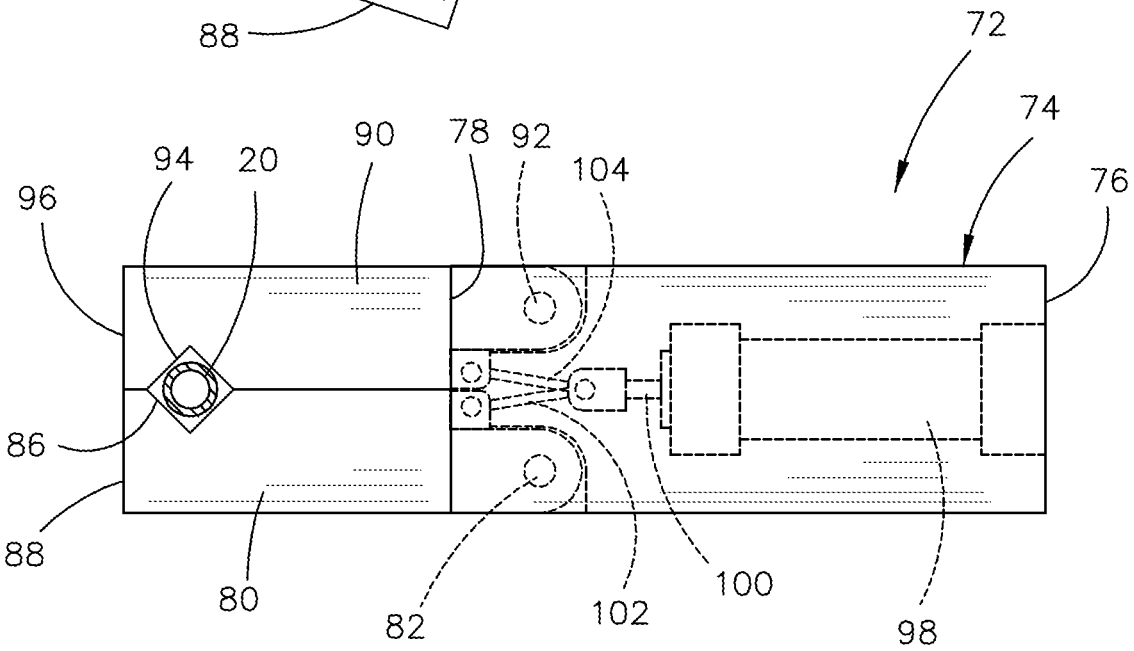
FIG. 11B is a view similar to FIG. 11A except that the tube guide is in the closed position.

The numeral 70 refers to a horizontally disposed support which is secured to the lower end of rack 66 and which extends outwardly therefrom. A dip tube guide assembly 72 is secured to the underside of support 70. Dip tube guide assembly 72 includes an elongated housing 74 having an outer end 76 and an inner end 78. A clamp arm 80 is pivotally secured to housing 74 by a pivot pin 82 about a vertical axis at the inner end 84 of clamp arm 86. Clamp arm 80 has a V-shaped notch 86 formed therein inwardly of its outer end 88. A clamp arm 90 is pivotally secured to housing 74 by a pivot pin 92 about a vertical axis at the inner end 93 of clamp arm 90. Clamp arm 90 has a V-shaped notch 94 formed therein inwardly of its outer end 96. An air cylinder 98 is positioned in housing 74 and has a cylinder rod 100 extending therefrom. Cylinder rod 100 is pivotally connected to clamp arm 80 by rod 102. Cylinder rod 100 is pivotally connected to clamp arm 90 by rod 104. When rod 100 is extended, the clamp arms 80 and 90 are in their open position of FIG. 11A. When rod 100 is retracted, the clamp arms 80 and 90 are in their position of FIG. 11B.

Figure 12A:
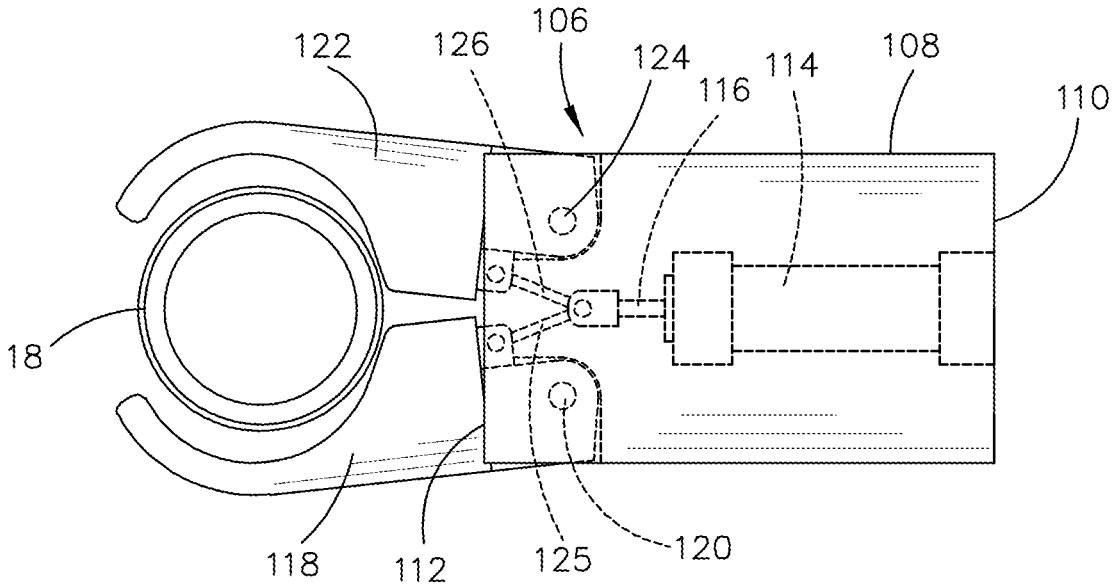
FIG. 12A is an upper elevational view of the container stabilizer in its open position.
Figure 12B:
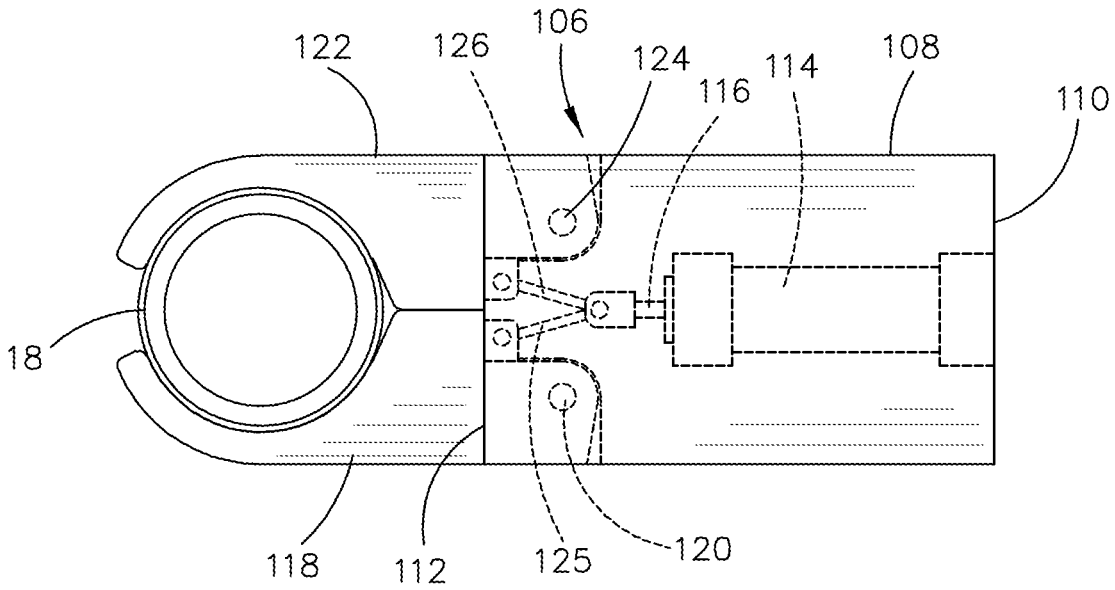
FIG. 12B is a view similar to FIG. 12A but which shows the container stabilizer in its closed position.

Referring now to FIGS. 12A and 12B, the numeral 106 refers to a container stabilizer which is positioned below housing 74 of dip tube guide assembly 72. Stabilizer 106 includes a housing 108 having an inner end 110 and an outer end 112. An air cylinder 114 is positioned in housing 108 and has a cylinder rod 116 extending therefrom. The numeral 118 refers to a first arcuate positioning member which is pivotally secured to housing 108 by a vertically disposed pivot pin 120. The numeral 122 refers to a second arcuate positioning member which is pivotally secured to housing 108 by a vertically disposed pivot pin 124. Rod 125 pivotally interconnects member 118 to rod 116 of cylinder 114. Rod 126 pivotally interconnects member 122 to rod 116 of cylinder 114.

When cylinder rod 116 is in its extended position of FIG. 12A, the positioning members 118 and 122 are in the open position. When cylinder rod 116 is in its retracted position of FIG. 12B, the positioning members 118 and 122 will embrace the throat 18 of the container 12 to hold the container 12 in place as the container insert 16 is being inserted into the throat 18 of container 12.

Figure 2:
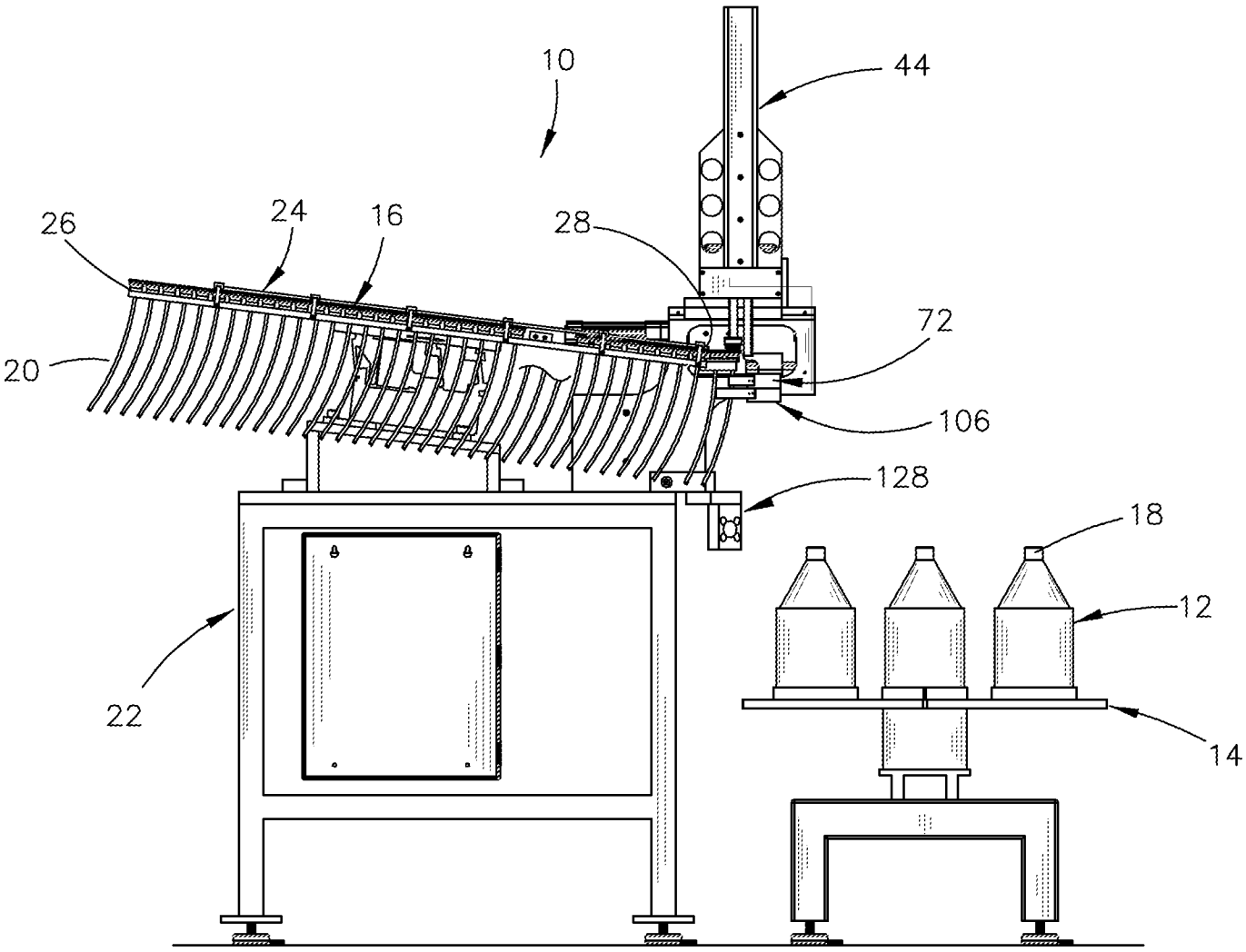
FIG. 2 is a side view of the machine of this invention about to insert a container insert into a liquid chemical container.
Figure 2A:
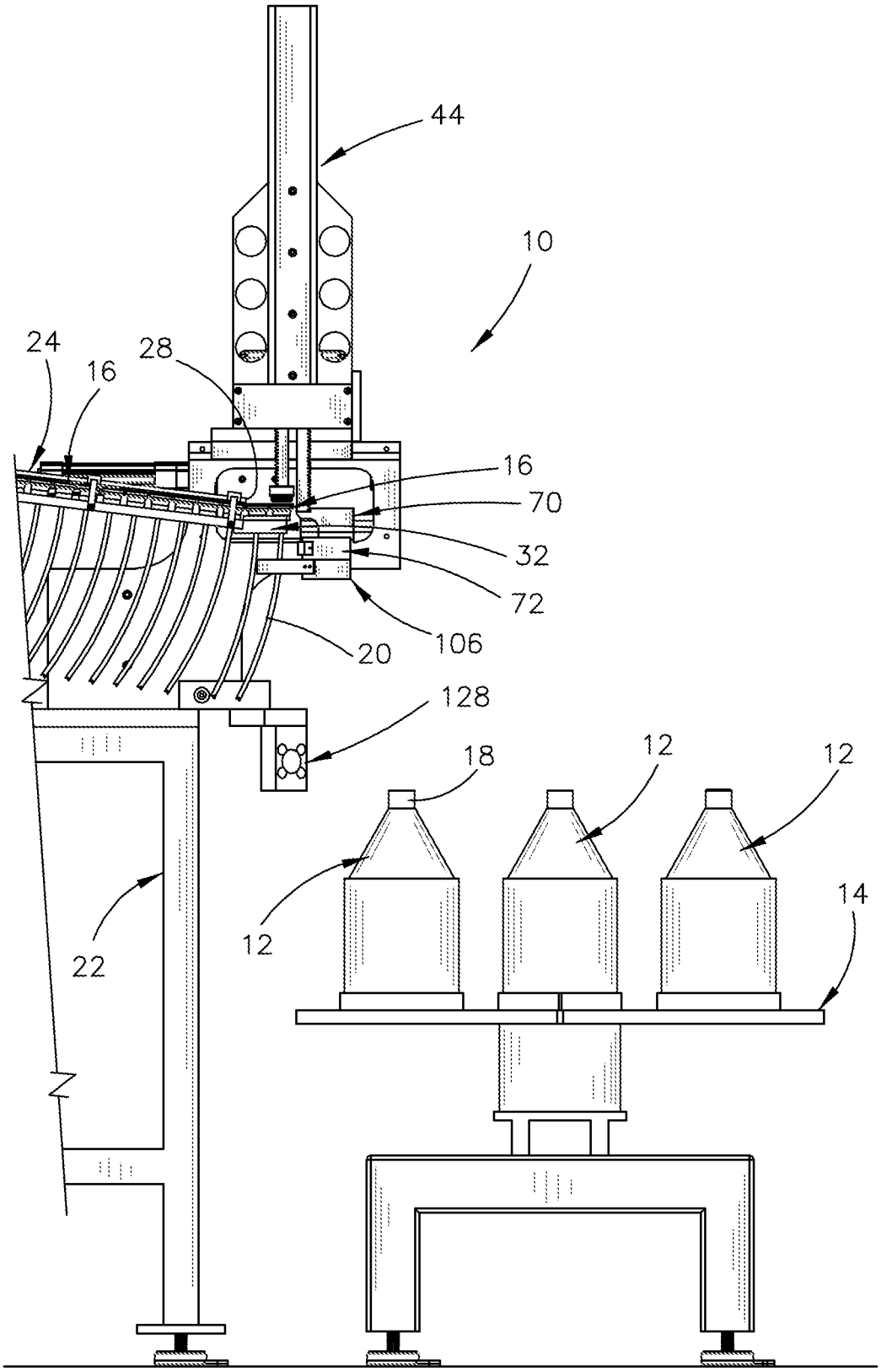
FIGS. 2A-2I are partial side views illustrating the sequence operation of the machine of this invention.
Figure 2B:
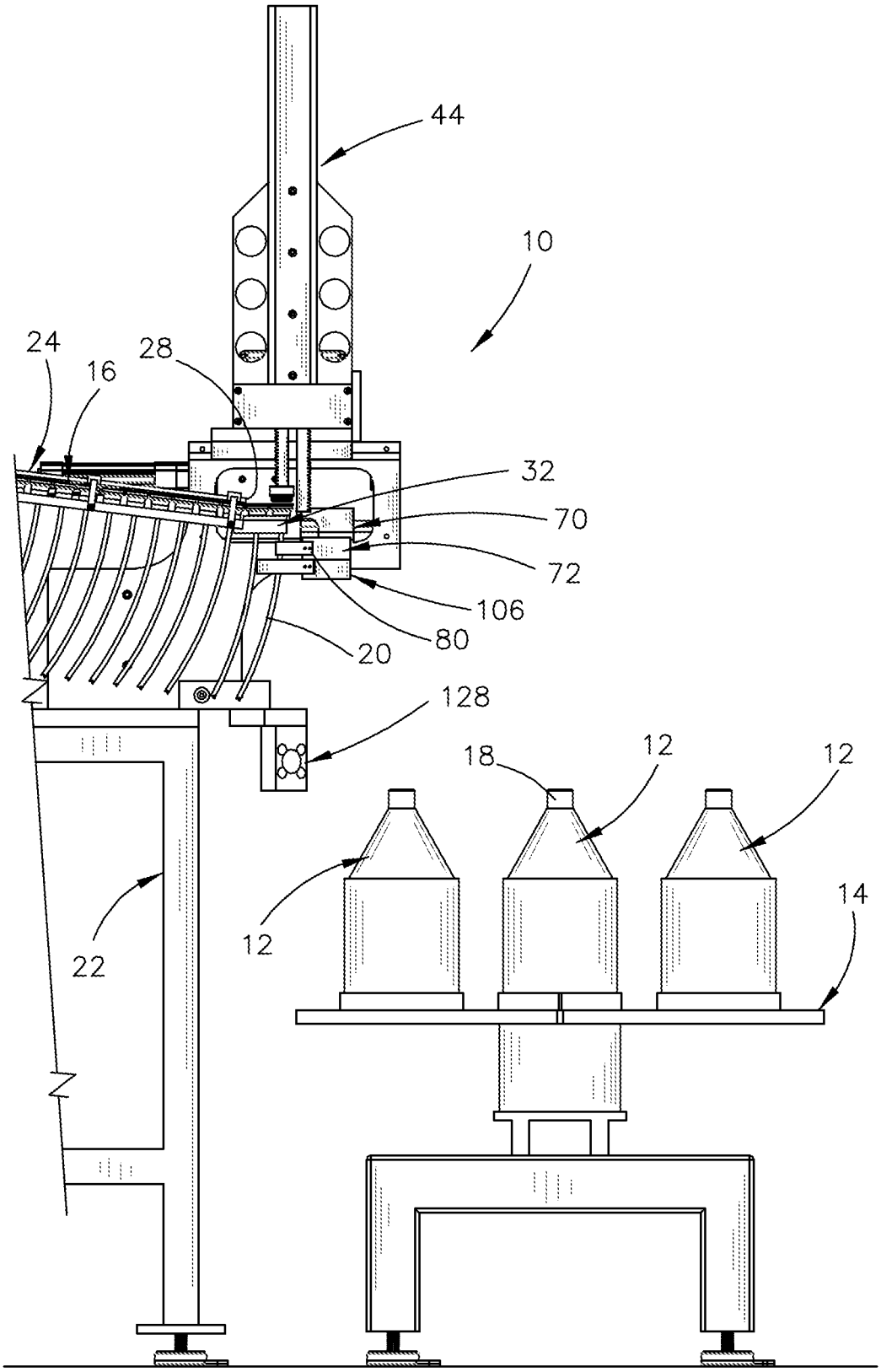
Figure 2C:
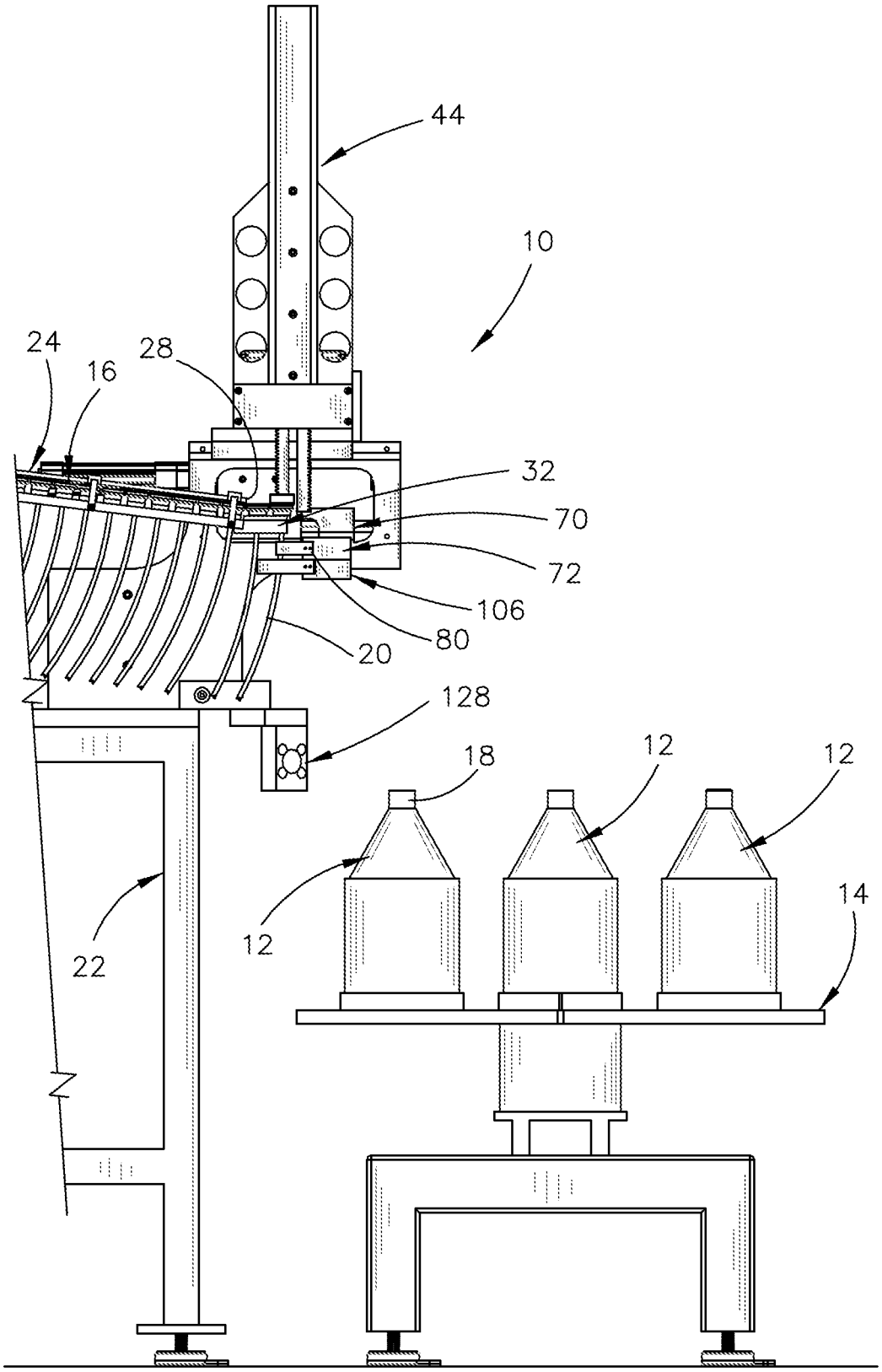
Figure 2D:
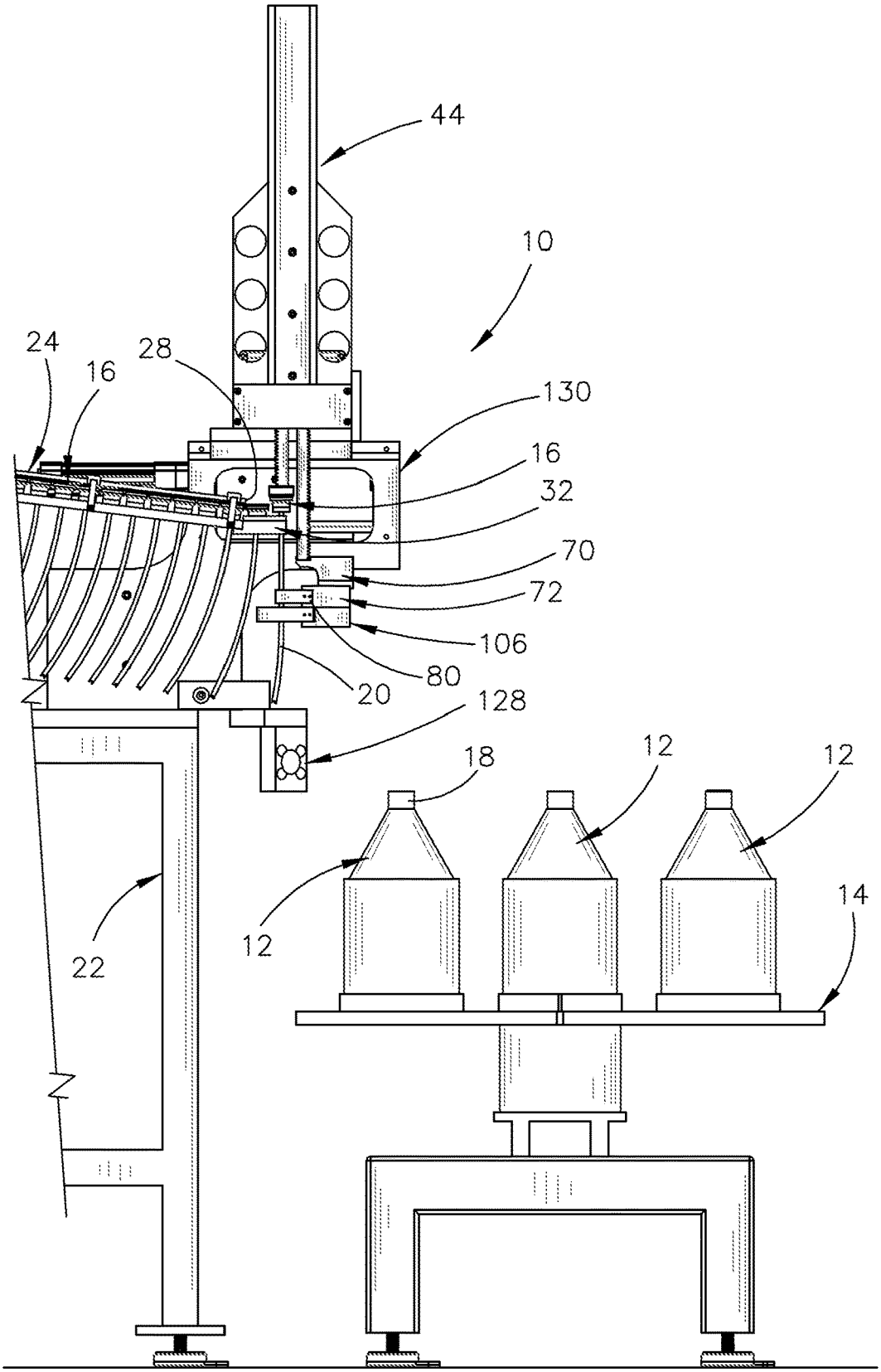
Figure 2E:
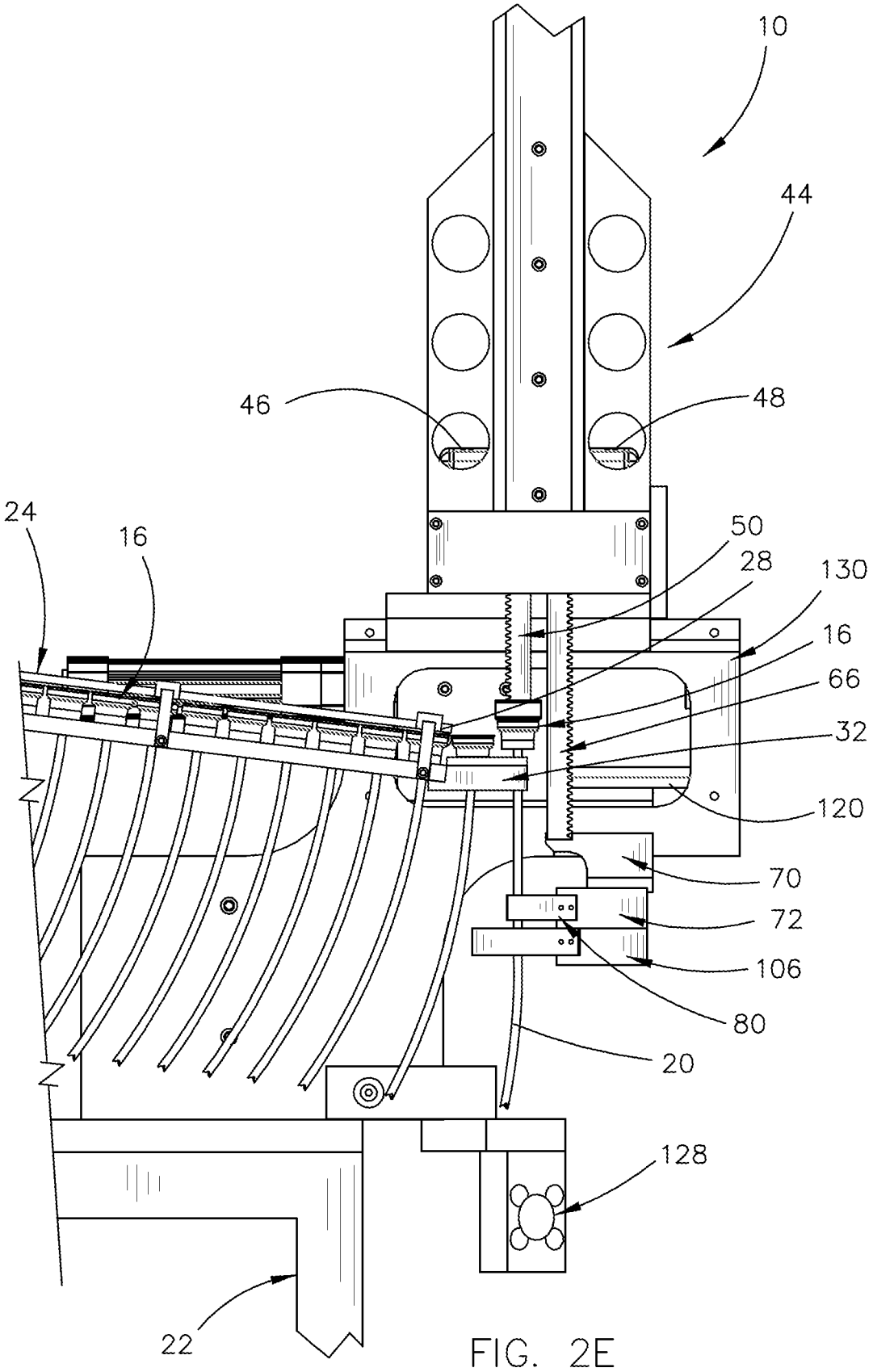
Figure 2F:
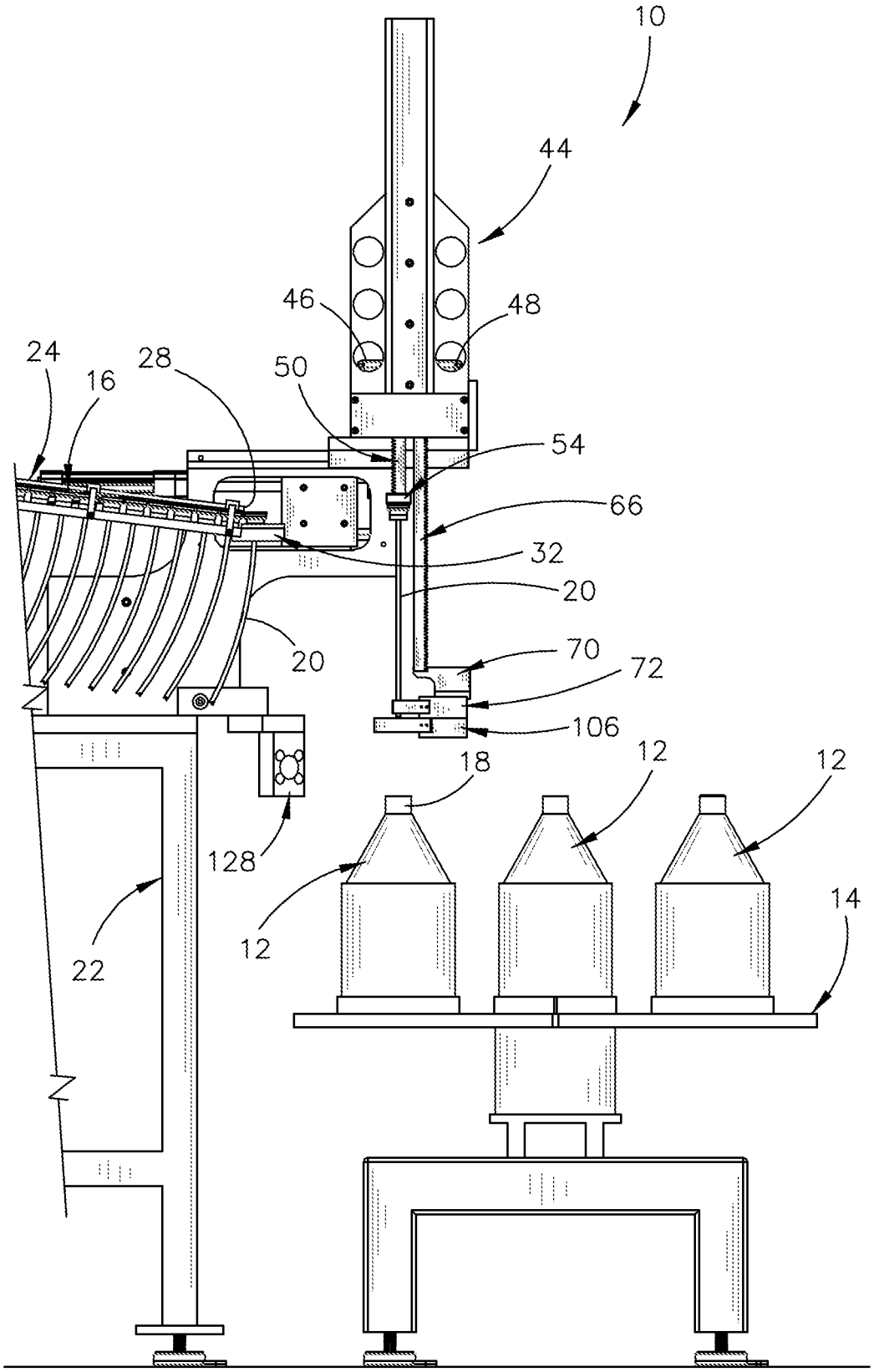
Figure 2G:
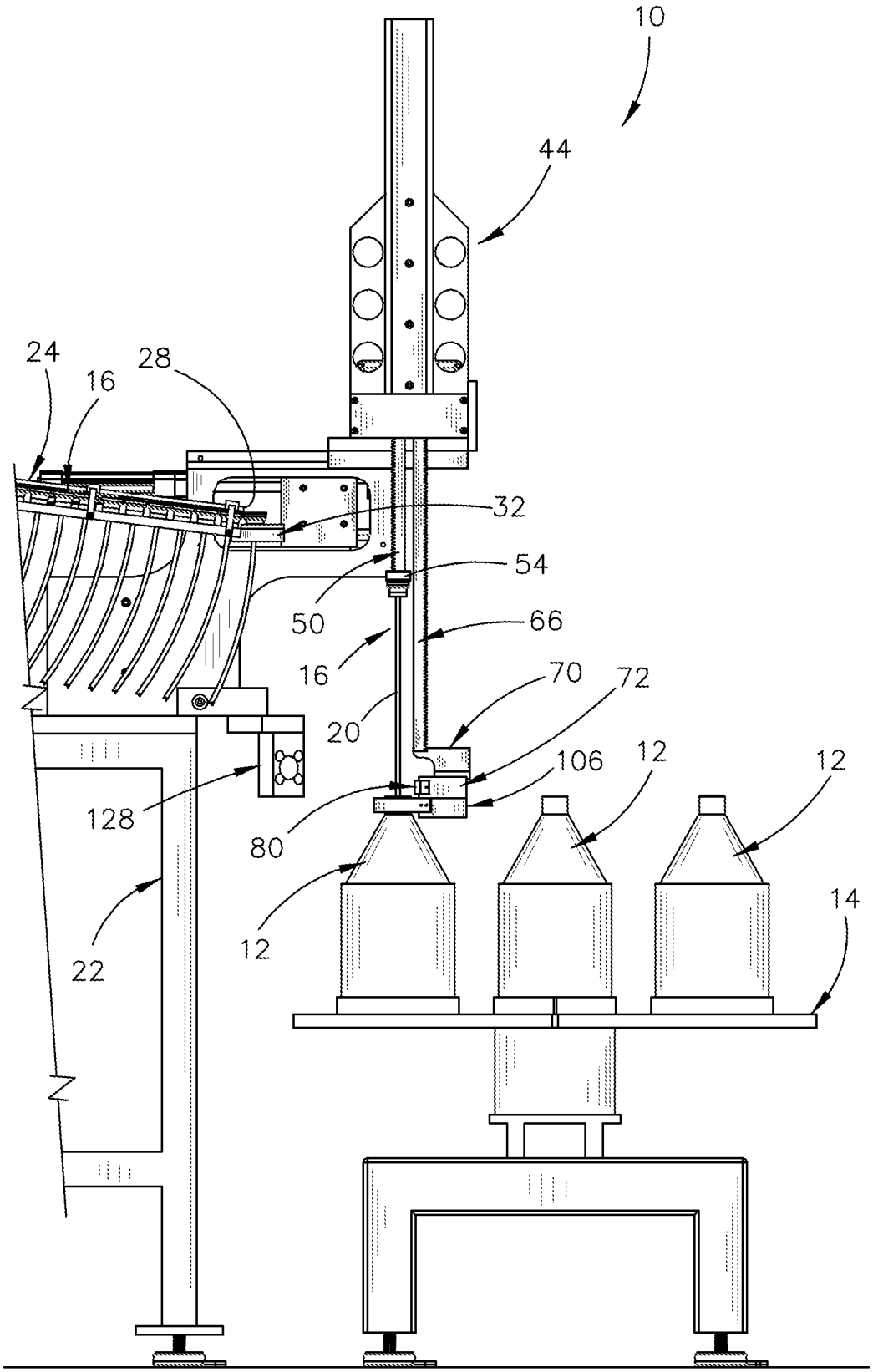
Figure 2H:
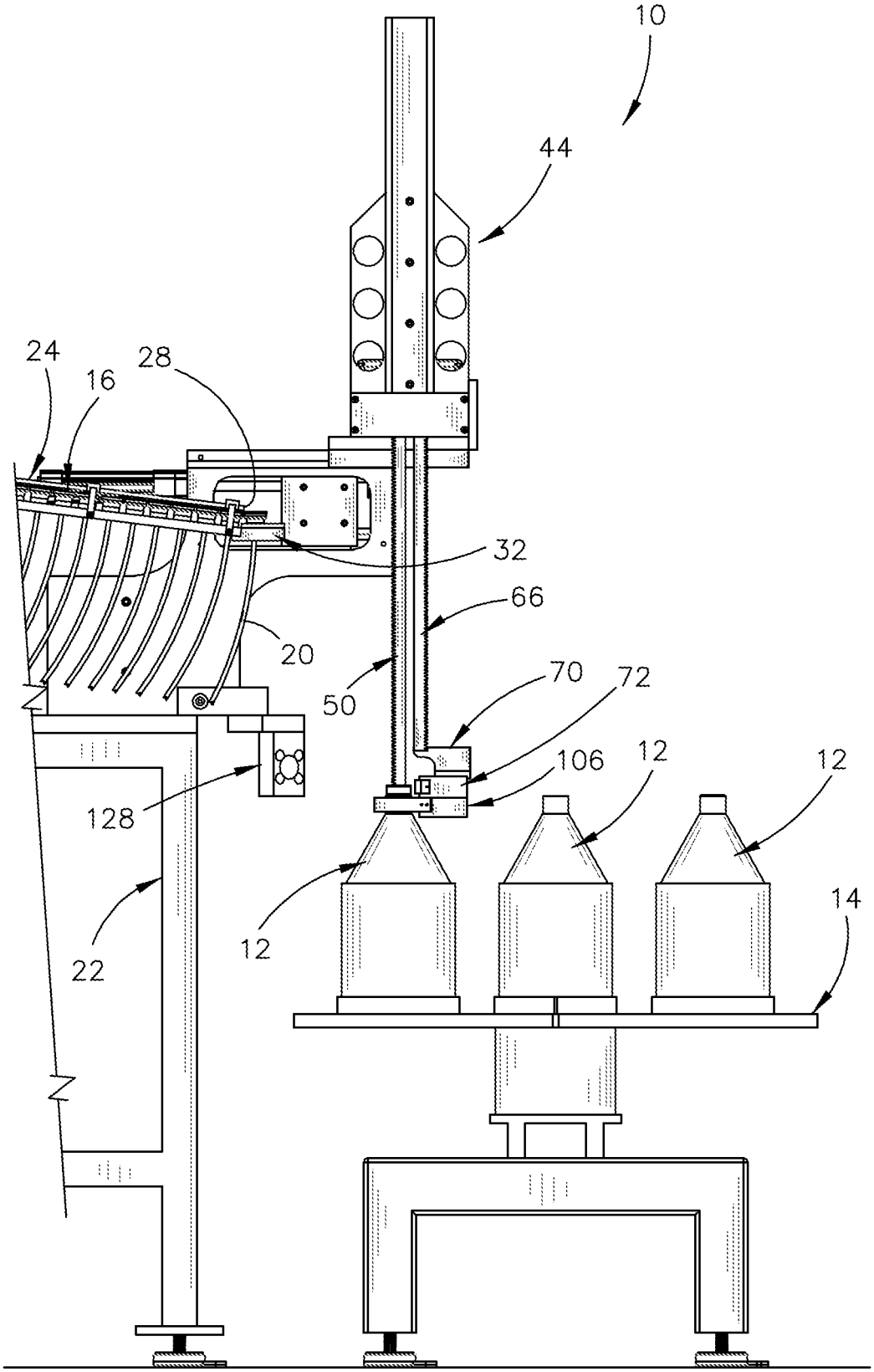
Figure 2I:
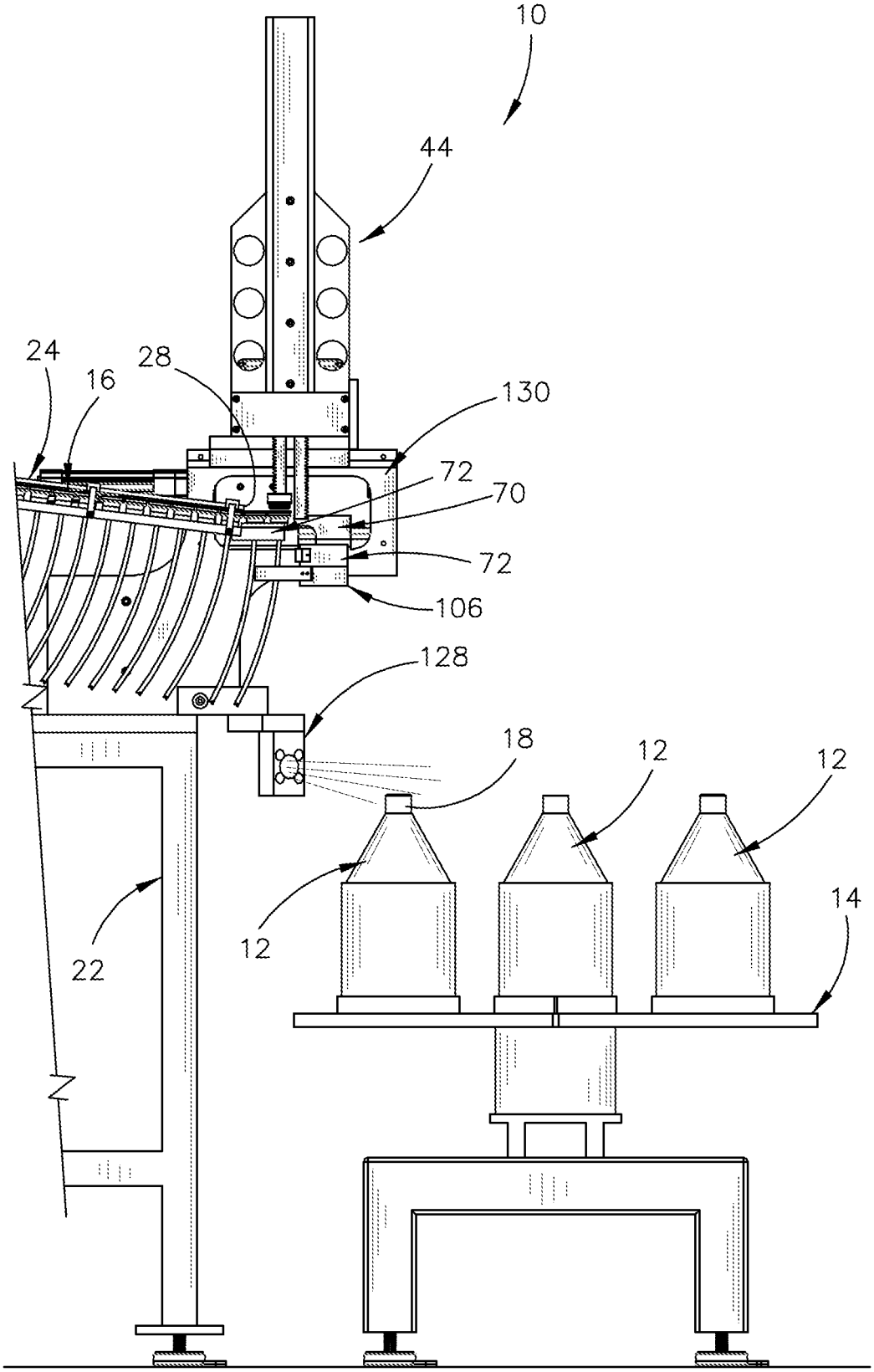
Figure 2J:
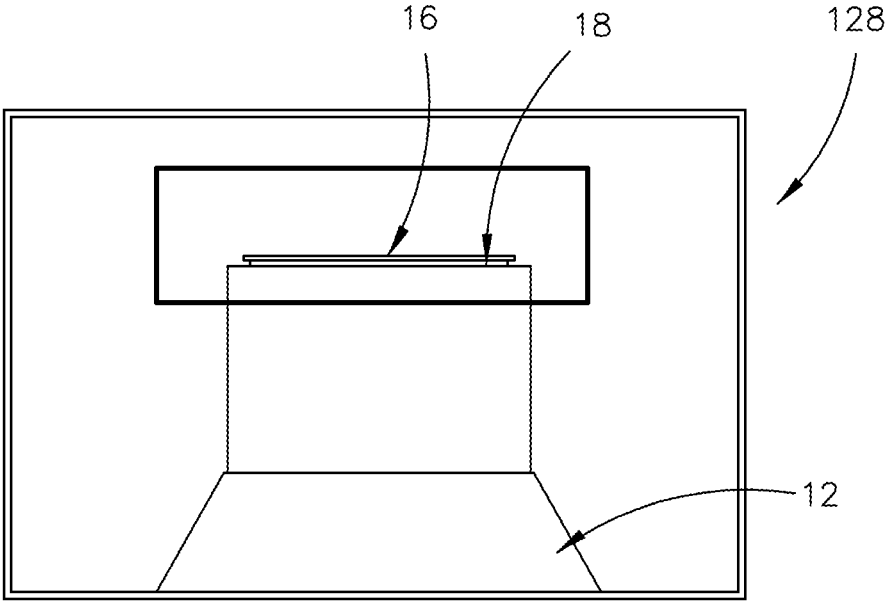
FIG. 2J is a side view of the output of the vision camera where the container insert has been properly installed in a liquid chemical container.
Figure 2K:
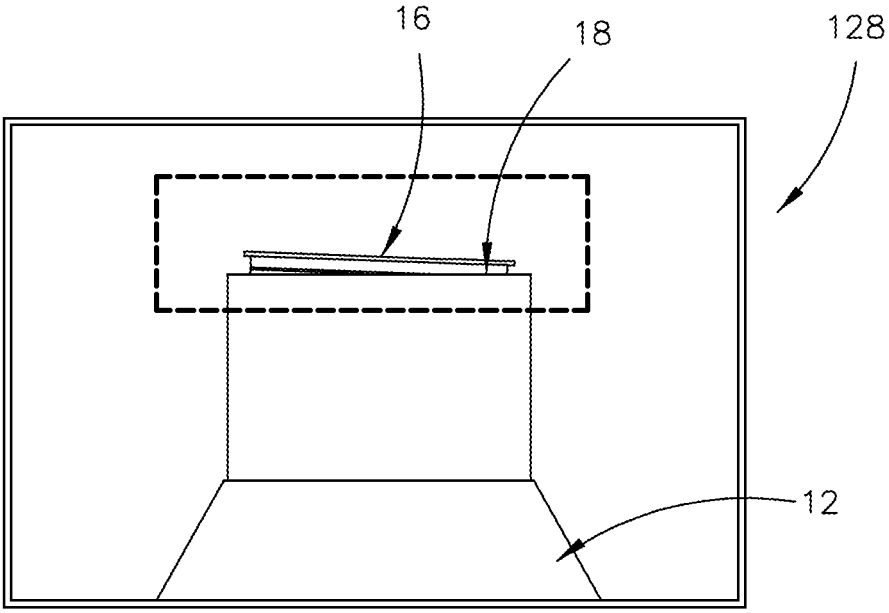
FIG. 2K is a side view of the output of the vision camera when the container insert was improperly installed in the liquid chemical container.
Figure 3:
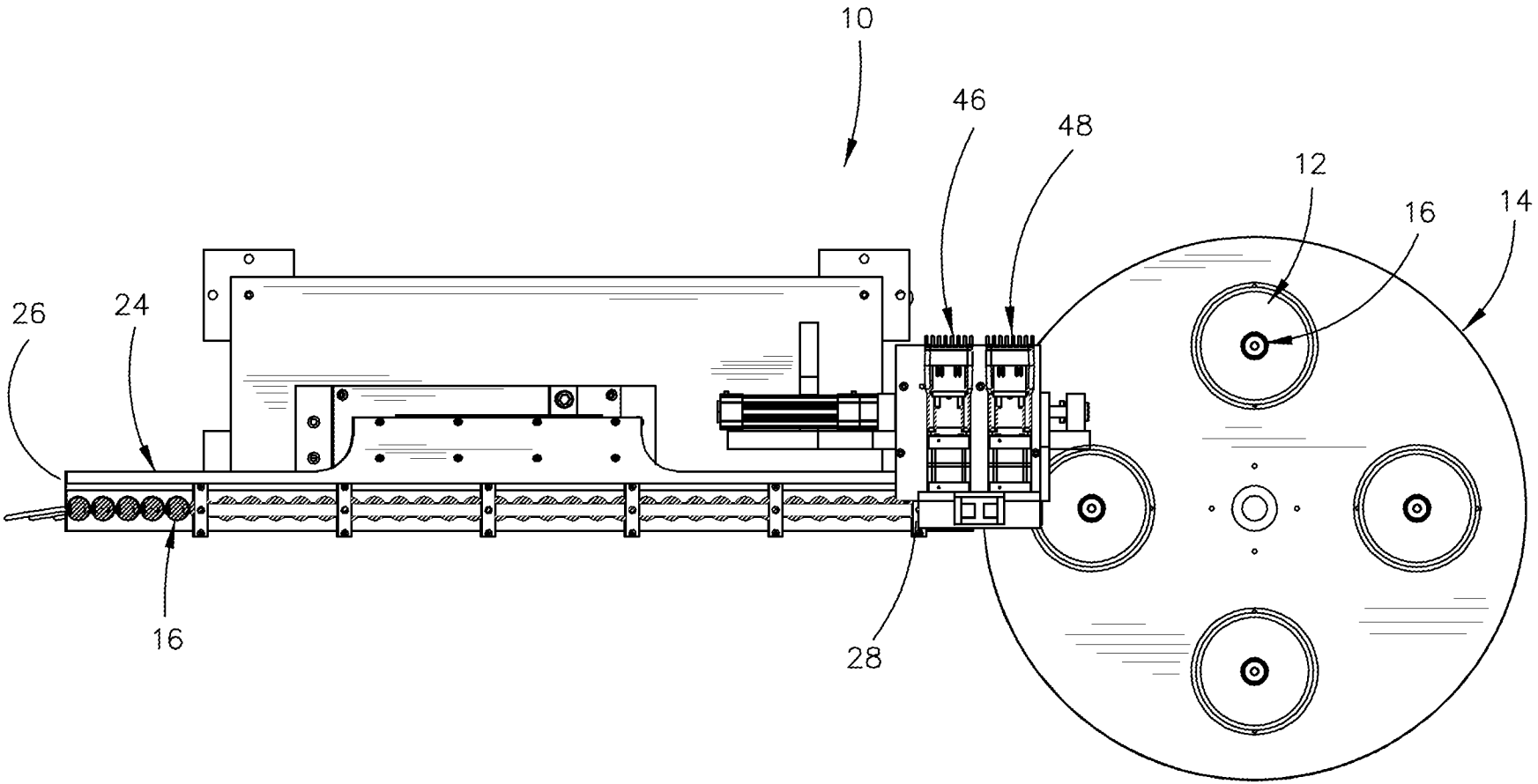
FIG. 3 is a top view of the machine of this invention about to insert a container insert into a liquid chemical container.
Figure 4:
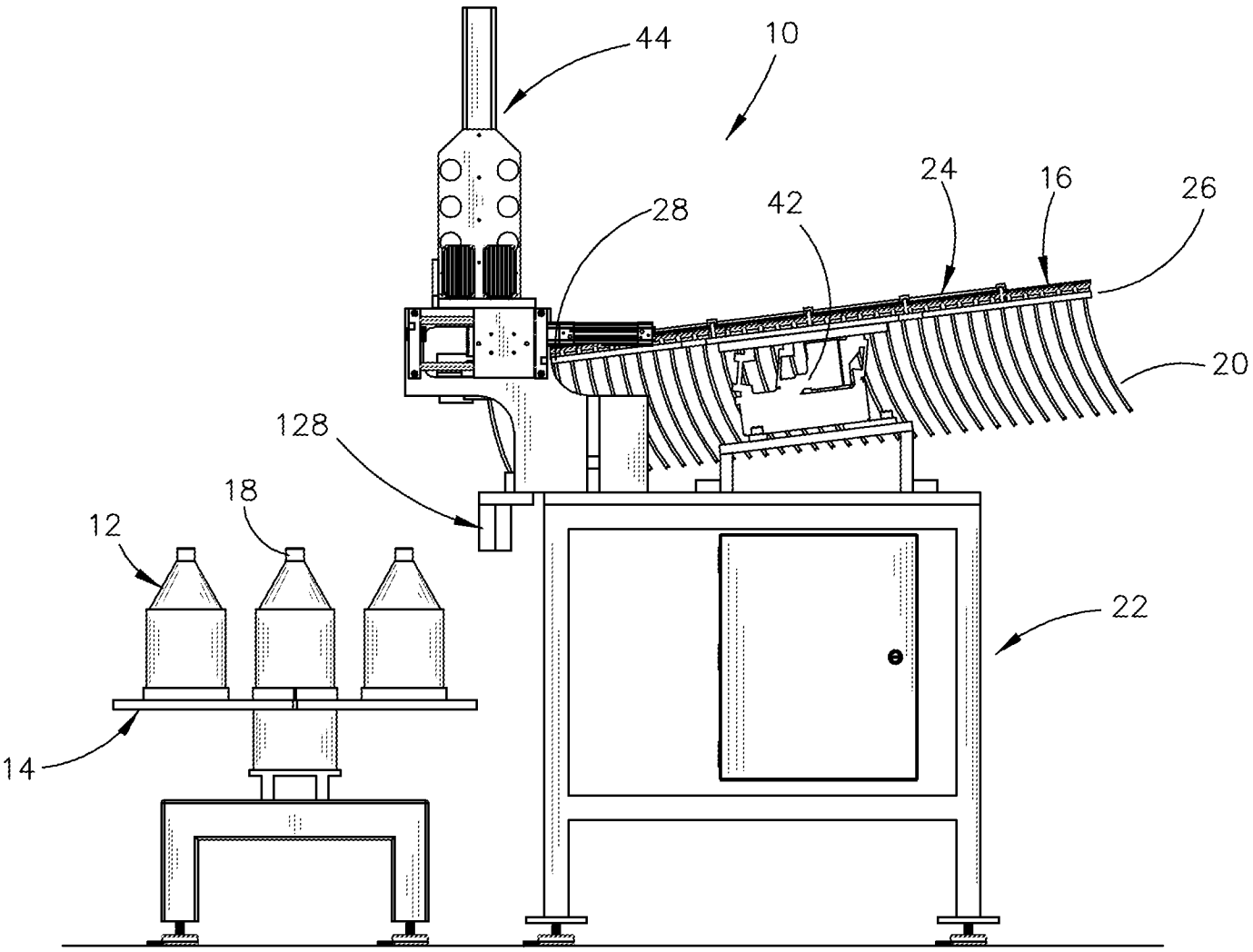
FIG. 4 is a side view of the machine of this invention about to insert a container insert into a liquid chemical container.

The numeral 128 refers to a vision camera which is secured to stand 22 and which is directed towards the throat 18 of the container 12 into which a container 16 is inserted. Vision camera 128 indicates in FIG. 2J that the container insert 16 has been properly inserted into the throat 18 of the container 12. Vision camera 128 indicates in FIG. 2K that the container insert 16 has been improperly inserted into the throat 18 of container 12.

The numeral 130 refers to a support which is movable with respect to the stand 22 between inner and outer positions. The servomotor support 44, the servomotors 46 and 48, the inserter 50, the rack 66, the support 70, dip tube guide assembly 72 and the container assembly 106 are mounted on the support 130 and are horizontally movable between inner and outer positions relative to the support tray 24 and the stand 22 by a hydraulic or pneumatic cylinder 132 connected to support 130.

The operation of apparatus 10 will now be described. The support 130 will normally be in its outer position but initially could be in its inner position. When support 130 is in its outer position, the servomotor support 44, servomotors 46 and 48, inserter 50, rack 66, support 70, dip tube guide assembly 72 and container stabilizer 106 will be positioned outwardly of the inner end 28 of insert tray 24 and insert positioner 32. The insert tray 24 will be filled with container inserts 16 and the vibrator 42 will be activated. It should be noted that more than one insert tray 24 may be utilized. In the initial outer position, the clamp arms 80 and 90 will be in the open position of FIG. 11A. In the initial outer position, the positioning members 118 and 122 will be in the open position of FIG. 12A. In the initial outer position, inserter 50 will be in its upper position. In the initial outer position, rack 66 will usually be in its upper position.

Figure 5:
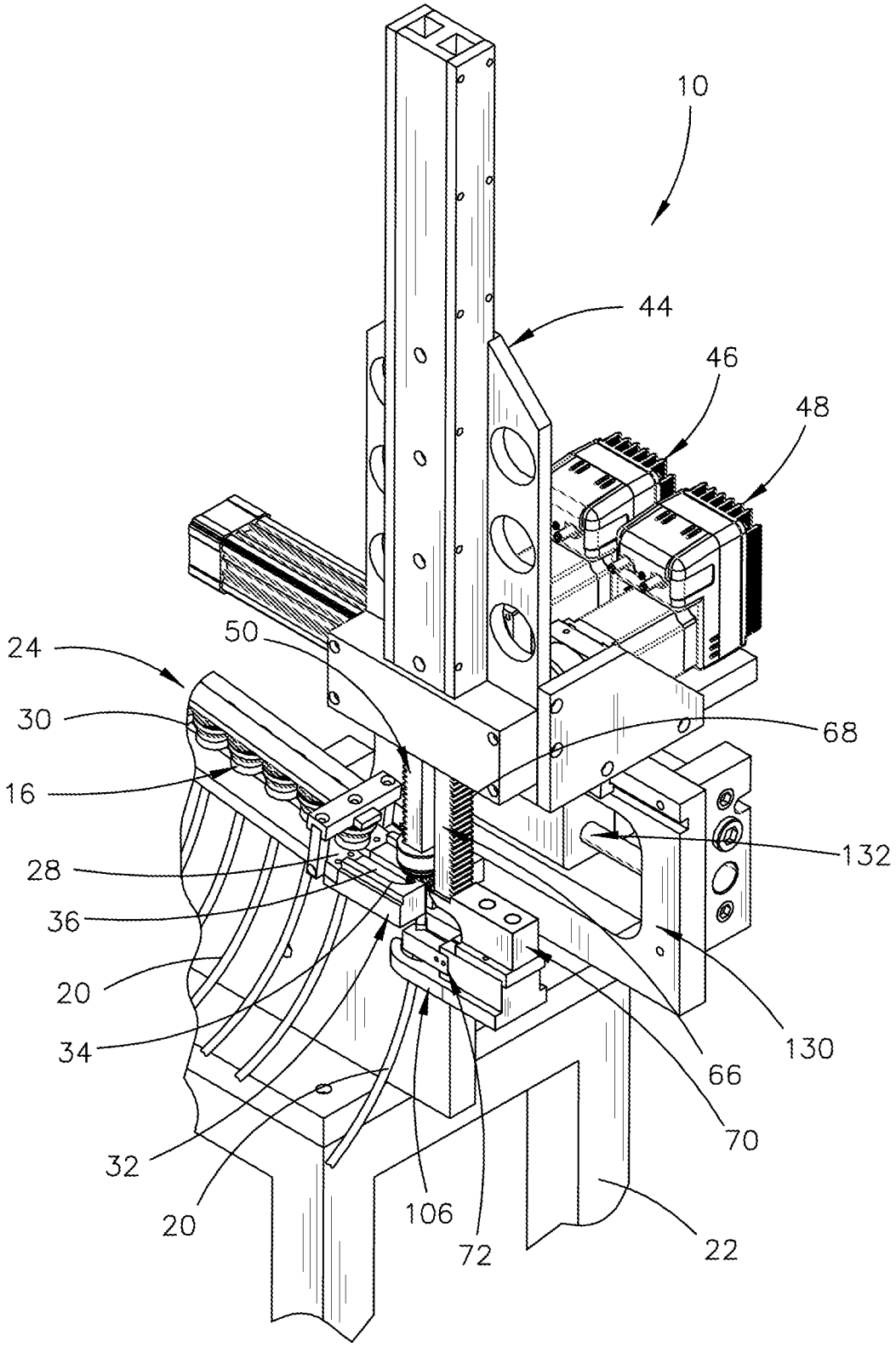
FIG. 5 is a partial front perspective view of the machine of this invention after outermost insert container is about to be moved downwardly with respect to the machine of this invention.
Figure 5A:
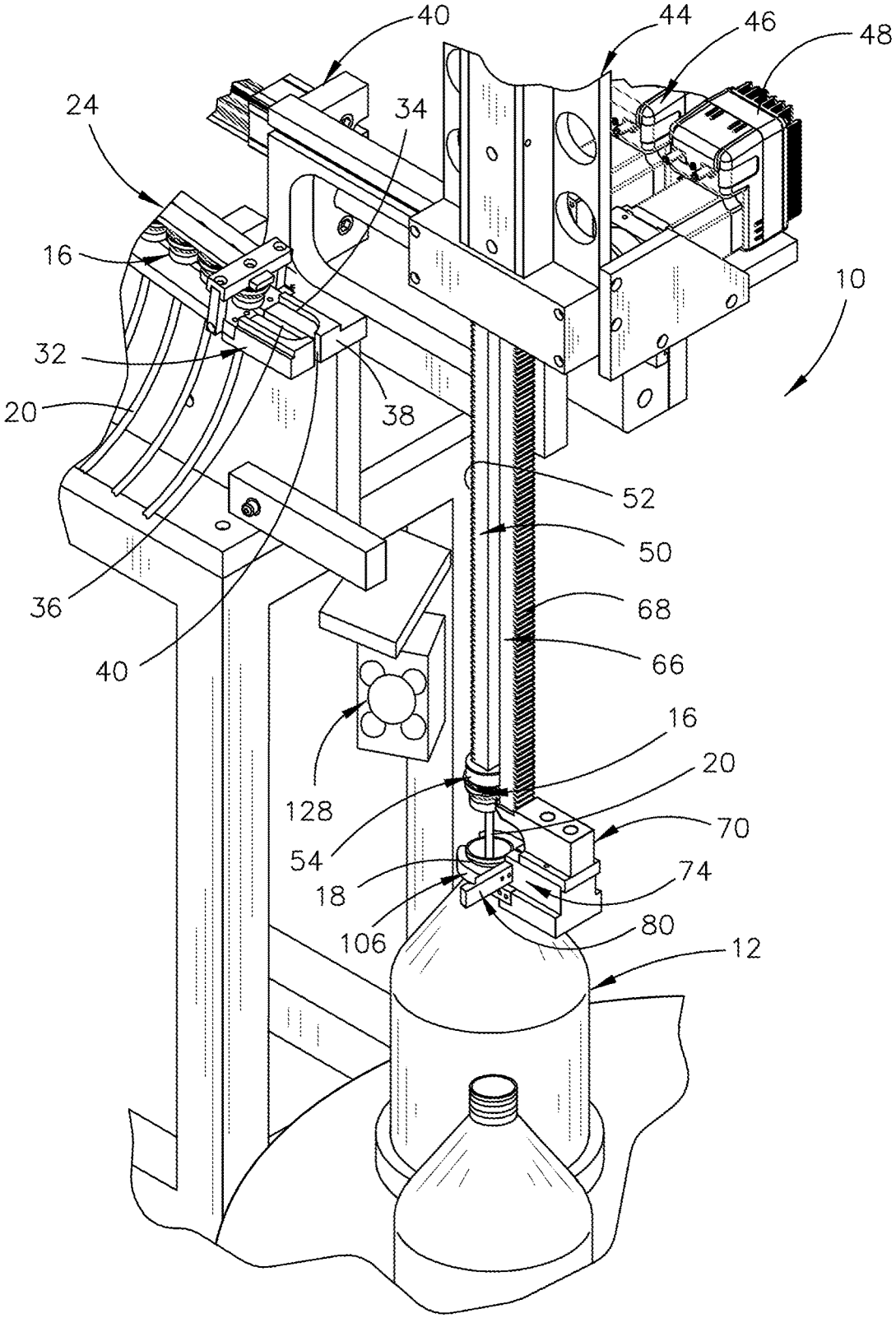
FIG. 5A is a partial front perspective view of the machine of this invention lowering a container insert into the throat of a liquid chemical container.
Figure 6:
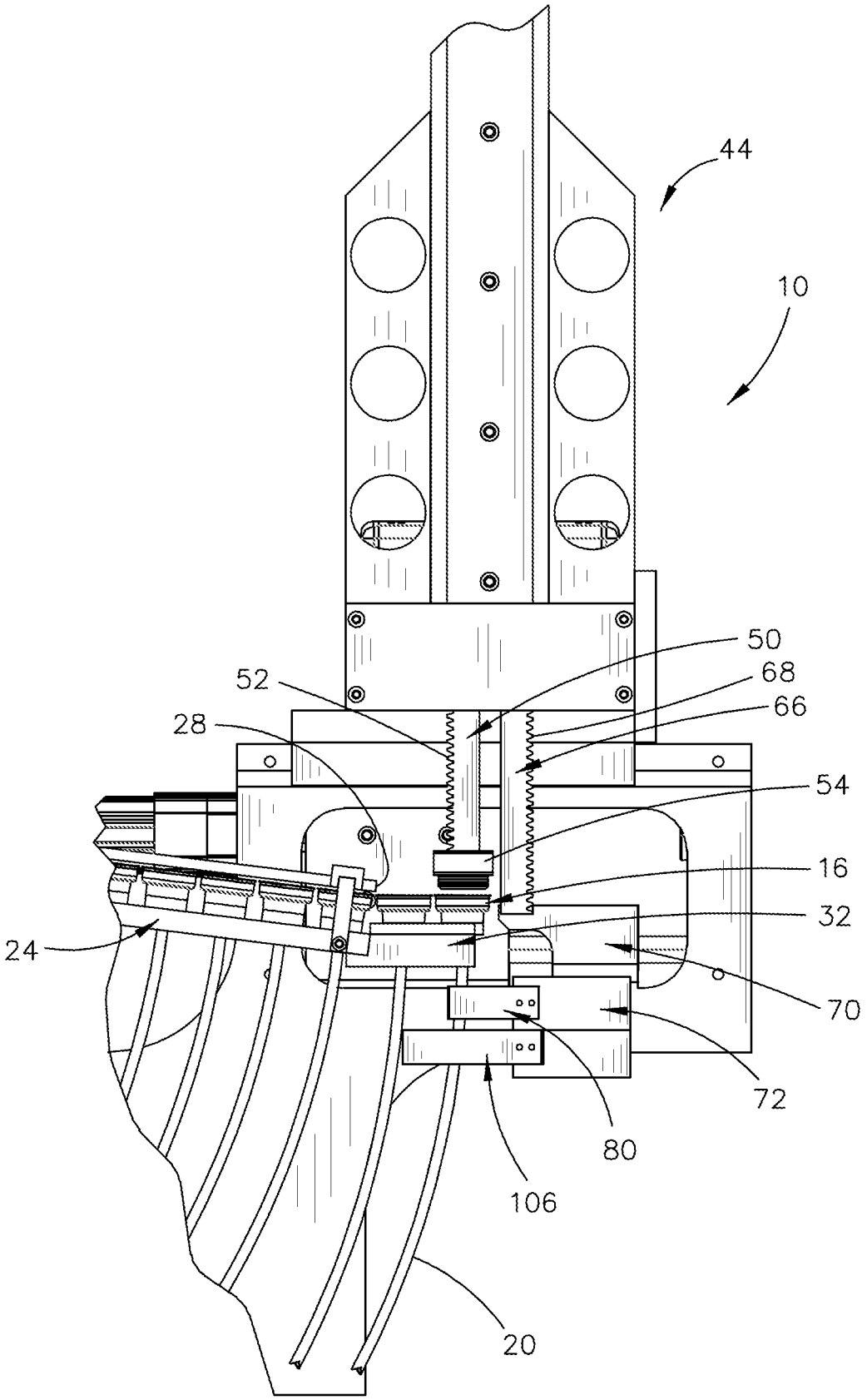
FIG. 6 is a partial side view of the machine of this invention after the dip tube of the outermost container insert has been embraced by a tube guide and a container positioner.
Figure 7:
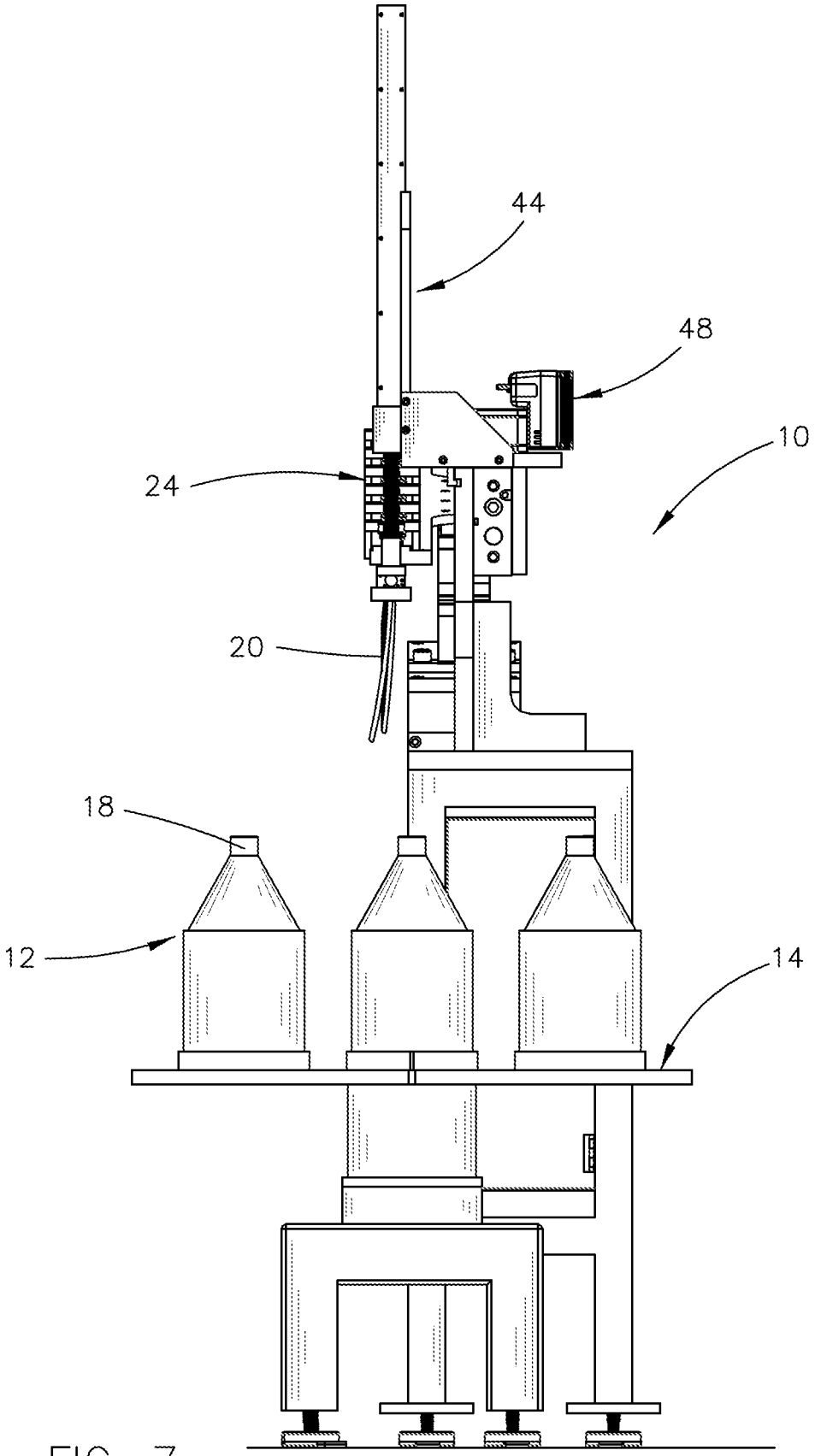
FIG. 7 is a front view of the machine of this invention.
Figure 8:
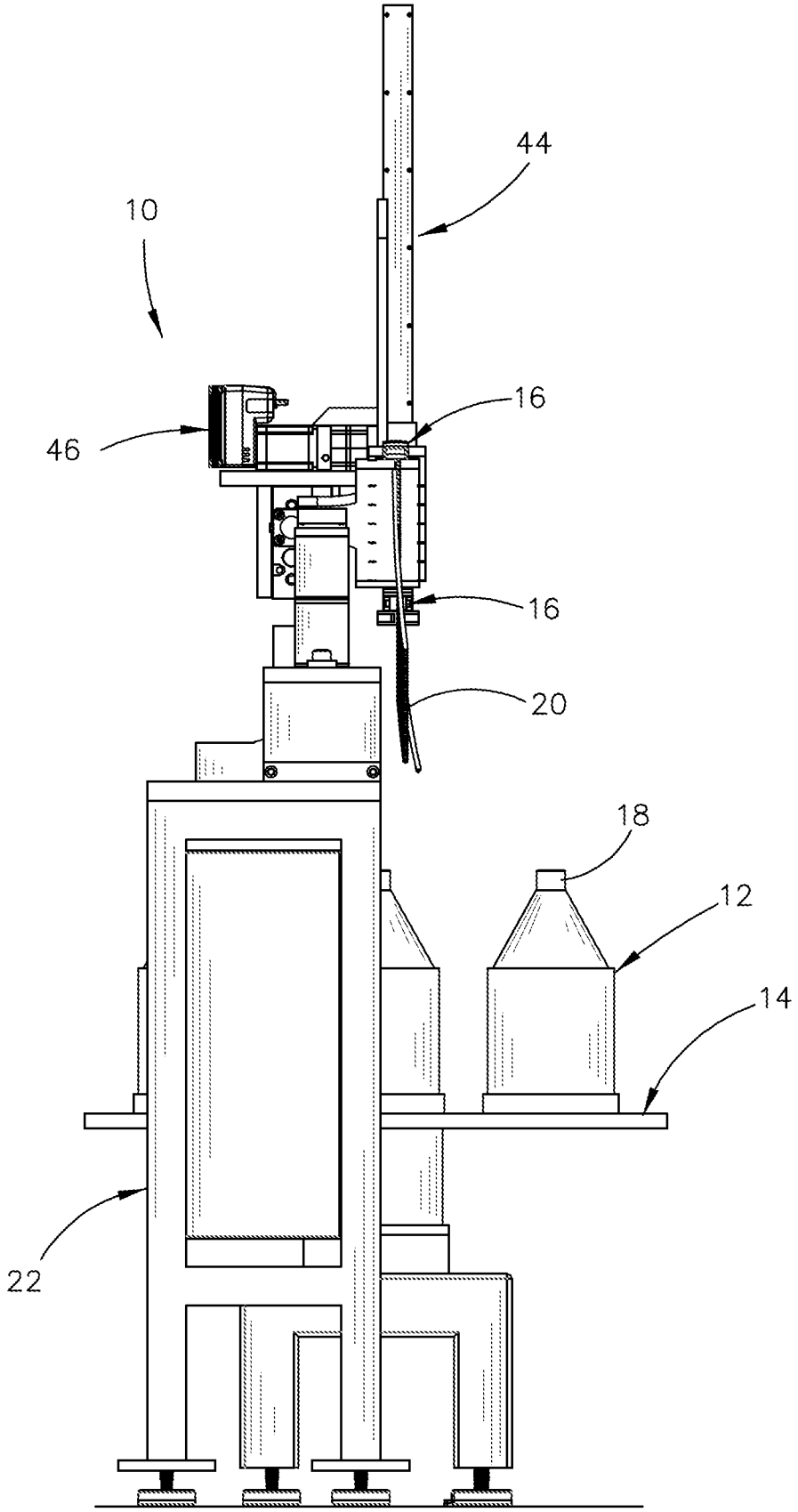
FIG. 8 is a rear view of the machine of this invention.
Figure 9A:
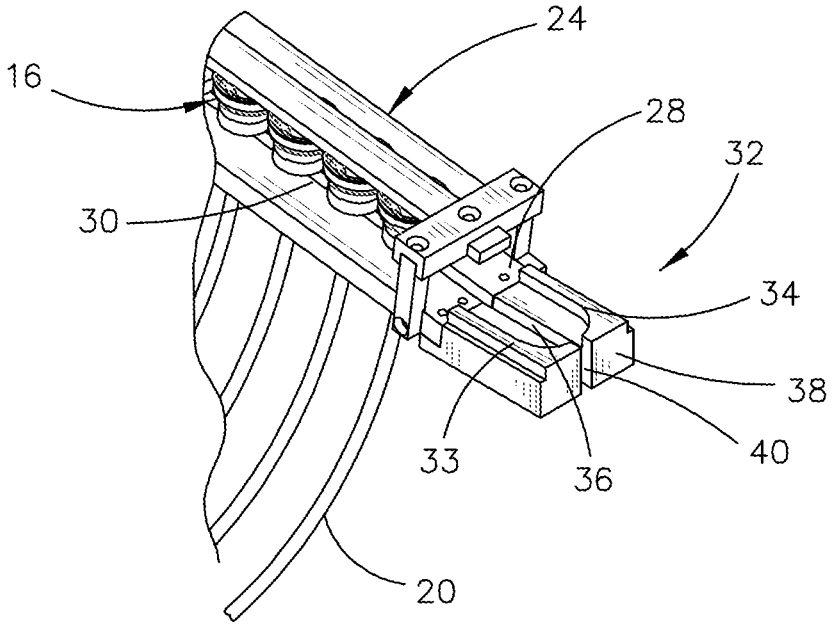
FIG. 9A is a partial perspective view of the insert positioner which is located at the inner end of the insert tray.
Figure 9B:
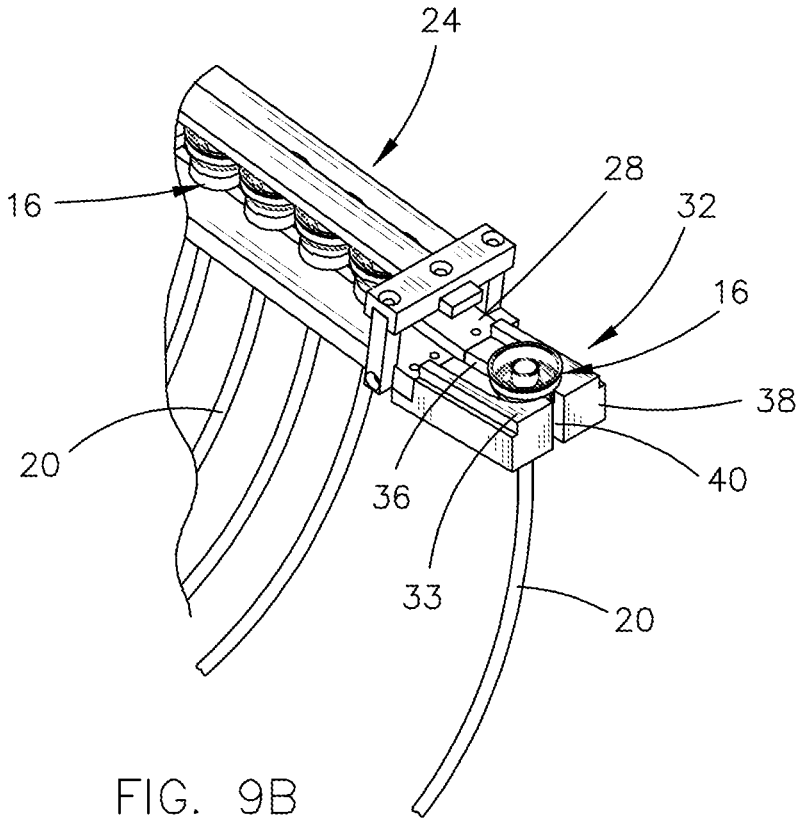
FIG. 9B is a view similar to FIG. 9A except that an insert is positioned in the positioner of FIG. 9A.

At this time, a container insert 16 will be in positioner 32. Support 130 will be moved to its inner position by cylinder 132 so that the lower end of inserter 50 is positioned directly above the container insert 16 in positioner 32. Rack 66 will be moved to its upper position by servomotor 48 so that the support 70 is in the position of FIG. 5. Inserter 50 is then moved downwardly so that head 54 thereof is moved downwardly into the container insert 16 as illustrated in FIG. 10B. The O-ring 62 on head 54 will frictionally engage the inner walls of the container insert 16. Inserter 50 will then be moved upwardly a short distance, with the container insert 16 also being moved upwardly due to the frictional engagement of the head 54 with the container insert 16, so that the lower end of the container insert 16 is above the upper wall of the positioner 32. The support 130 is then moved to its outer position so that the servomotor support 44, servomotors 46 and 48, inserter 50 with the container insert 16 attached to the head 54 of inserter 50, rack 66, support 70, dip tube guide assembly 72 and container stabilizer 106 will be moved outwardly so that head 54 of inverter 50 will be positioned above the throat 18 of the container 12 and so that the dip tube guide assembly 72 will be positioned at one side of the dip tube 20 and so that the positioning members 118 and 122 are positioned above the throat 18 of the container 12.

The clamp arms 80 and 90 are then closed so that the dip tube 20 is loosely positioned in the notches 86 and 94 of clamp arms 80 and 90 respectively. In an almost simultaneous manner, inserter 50, dip tube guide assembly 72 and container stabilizer 106 will be lowered. During the downward movement of the inserter 50, the dip tube guide assembly 72 slides downwardly on the dip tube 20 to move the lower end of the dip tube 20 in alignment with the throat 18 of the container 12. Prior to the insert 16 being inserted into the throat 18 of the container 12, the container stabilizer 106, which is in the open position, will be positioned around the throat 18 of the container 12. The positioning members 118 and 120 will then be moved from their open position of FIG. 12A to the closed position around throat 18 whereby the positioning members 118 and 120 will grasp the throat 18 to hold the container 12 in position. When the lower end of the dip tube 20 has been inserted into the container 12, the clamp arms 80 and 90 are moved to their open positions.

The inserter 50 is lowered until the insert 16 is positioned in the throat 18 of the container 12. The vision camera 128 then illustrates whether the insert 16 has been properly inserted into the throat 18 of the container 12. When the insert 16 has been inserted into the throat of the container 12, the inserter 50 is raised. At that time, the positioning members 118 and 120 will have been opened so that the container stabilizer 106 may be raised upwardly with the support 70 and the dip tube guide assembly 72. The inserter 50, dip tube guide assembly 72 and the container stabilizer 106 will be returned to their starting position to begin another cycle.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An apparatus for inserting a container insert, having a dip tube extending downwardly therefrom, into the throat of a liquid container, comprising:

a support frame;

an elongated container insert tray, having inner and outer ends;

said container insert tray being configured to support a plurality of container inserts therein in an upright position in a row;

a sub-frame movably secured to said support frame and being movable between inner and outer positions with respect to said support frame;

a vertically movable inserter, having upper and lower ends, secured to said sub-frame for horizontal movement therewith between inner and outer positions;

said vertically movable inserter being vertically movable between upper and lower positions with respect to said sub-frame;

said vertically movable inserter having a head portion at its lower end which is configured to individually engage said container inserts;

said inserter, when said sub-frame is in said inner position, being positioned above said innermost container insert;

said head portion of said inserter, when engaging a container insert, capable of moving the container insert to a position over the throat of the container when said sub-frame is moved to said outer position;

said inserter, when moved from said upper position to said lower position and said sub-frame is in said outer position, forcing the container insert into the throat of the container; and a container positioning assembly which embraces the throat of the container in which the insert is being placed.

2. In combination:

a liquid container having a throat at its upper end;

a container insert for positioning in said throat;

said insert including a dip tube;

a vertically movable inserter, having upper and lower ends, positioned above said container insert;

said inserter being movable between upper and lower positions;

said lower end of said inserter being configured to engage the container insert and to drive the container insert into said throat when said inserter is moved from the upper position to said lower position; and a container stabilizer which engages the throat of the container when the insert is being inserted into the throat of the container.

* * * * *